US010689844B2

(12) United States Patent
Patton et al.

(10) Patent No.: US 10,689,844 B2
(45) Date of Patent: Jun. 23, 2020

(54) QUICK ASSEMBLE WALL SYSTEM, AND RELATED METHODS

(71) Applicant: Varidesk, LLC, Coppell, TX (US)

(72) Inventors: David Patton, Flower Mound, TX (US); Michael Creighton, Warrington, PA (US); Ersen Boran, Chalfont, PA (US); Shuichi Amano, Bethlehem, PA (US); Gary Reuther, Warminster, PA (US); Nicholas Max, Quakertown, PA (US)

(73) Assignee: Varidesk, LLC, Coppell, TX (US)

( * ) Notice: Subject to any disclaimer, the term of this patent is extended or adjusted under 35 U.S.C. 154(b) by 18 days.

(21) Appl. No.: 15/979,909

(22) Filed: May 15, 2018

(65) Prior Publication Data

US 2018/0328033 A1 Nov. 15, 2018

Related U.S. Application Data

(60) Provisional application No. 62/506,346, filed on May 15, 2017.

(51) Int. Cl.
*E06B 1/04* (2006.01)
*E04B 2/74* (2006.01)
(Continued)

(52) U.S. Cl.
CPC ..... *E04B 2/7435* (2013.01); *E04B 2/7409* (2013.01); *E04B 2/7433* (2013.01);
(Continued)

(58) Field of Classification Search
CPC .... E04B 2/7433; E04B 2/7425; E04B 2/7422; E04B 2002/7462; E04B 2002/742;
(Continued)

(56) References Cited

U.S. PATENT DOCUMENTS 5,592,787 A * 1/1997 Ophardt ..... E04H 1/1266 52/239
5,642,593 A * 7/1997 Shieh ..... E04B 2/7424 160/130

(Continued)

FOREIGN PATENT DOCUMENTS

GB 2289701 A 11/1995
GB 2438775 A 12/2007

(Continued)

OTHER PUBLICATIONS

Extended European Search Report in related European Patent Application No. 18172295.0 dated Sep. 28, 2018.

(Continued)

*Primary Examiner* — Chi Q Nguyen
(74) *Attorney, Agent, or Firm* — Venable LLP; Michele V. Frank

(57) ABSTRACT

A wall panel for a quick assemble wall system may include a first upright post and a second upright post. The wall panel may also include a lower stretcher for connecting the first upright post to the second upright post and an upper stretcher for connecting the first upright post to the second upright post. The wall panel may include at least one frame for placement within the first vertical post, the second vertical post, the lower stretcher, and the upper stretcher. The wall panel may include a first retractable latch located on the at least one frame, the first retractable latch adapted to engage at least one of the first upright post, second upright post, lower stretcher, or upper stretcher. A frame for a quick assemble wall system and a method of assembling a quick assemble wall system are also described.

43 Claims, 21 Drawing Sheets

(51) Int. Cl.

| | |
|---|---|
| ***E05D 15/06*** | (2006.01) |
| ***E04B 2/78*** | (2006.01) |
| *E06B 3/46* | (2006.01) |
| *E05C 1/10* | (2006.01) |
| *E05B 65/00* | (2006.01) |
| *E05C 1/04* | (2006.01) |

(52) U.S. Cl.
CPC ..... *E04B 2/7453* (2013.01); *E04B 2/7818* (2013.01); *E05D 15/0626* (2013.01); *E04B 2002/742* (2013.01); *E04B 2002/749* (2013.01); *E04B 2002/7418* (2013.01); *E04B 2002/7446* (2013.01); *E04B 2002/7461* (2013.01); *E04B 2002/7462* (2013.01); *E04B 2002/7466* (2013.01); *E04B 2002/7488* (2013.01); *E05B 65/006* (2013.01); *E05C 1/04* (2013.01); *E05C 1/10* (2013.01); *E06B 3/4636* (2013.01)

(58) Field of Classification Search
CPC ..... E04B 2002/7446; E04B 2002/7466; E04B 2002/7487; E04B 2002/749; E04B 2002/7461
USPC ..... 52/239, 36.1, 220.7, 481.2, 482, 489.1, 52/220.1, 220.8, 489.2, 474
See application file for complete search history.

(56) References Cited

U.S. PATENT DOCUMENTS

| | | | | |
|---|---|---|---|---|
| 6,115,977 | A * | 9/2000 | Hornberger | A47B 95/008 52/238.1 |
| 6,341,457 | B1 * | 1/2002 | Aerts | E04B 2/7425 52/239 |
| 6,729,085 | B2 * | 5/2004 | Newhouse | B25B 5/003 52/239 |
| 7,975,445 | B2 * | 7/2011 | Parshad | E04B 2/7425 52/220.7 |
| 8,656,648 | B2 * | 2/2014 | Liegeois | E04B 2/7425 52/36.1 |
| 9,649,831 | B2 * | 5/2017 | Gosling | E04B 2/02 |
| 2002/0029529 | A1 | 3/2002 | Waalkes et al. | |
| 2007/0163190 | A1 | 7/2007 | Hofman et al. | |
| 2009/0090076 | A1 * | 4/2009 | Abusada | E04B 2/7425 52/239 |
| 2009/0094913 | A1 * | 4/2009 | Singh | E04B 2/7422 52/239 |
| 2010/0186326 | A1 * | 7/2010 | Cummings | E04B 2/7422 52/239 |
| 2015/0042107 | A1 | 2/2015 | Glickman et al. | |

FOREIGN PATENT DOCUMENTS

| | | | |
|---|---|---|---|
| JP | 2002065383 | A | 3/2002 |
| KR | 20040058760 | A | 7/2004 |
| KR | 101537087 | B1 | 7/2015 |

OTHER PUBLICATIONS

Office Action issued in related European Patent Application No. 18172295.0 dated Apr. 6, 2020.

* cited by examiner

QUICK ASSEMBLE WALL SYSTEM, AND RELATED METHODS

CROSS-REFERENCE TO RELATED APPLICATIONS

This application claims priority to U.S. Provisional Patent Application No. 62/506,346, filed May 15, 2017, which is hereby incorporated by reference in its entirety.

TECHNICAL FIELD

The present application relates to a quick assemble wall system and related methods. More specifically, the present application relates to a system for quickly installing and removing wall panel systems, for example, in an office environment.

BACKGROUND

Office spaces typically include large open areas which are divided into smaller workspaces by wall panel systems. The wall panel systems generally include wall panels each having frames and panels which can be modularly assembled to create a workspace. The wall panels can be assembled, disassembled, and reassembled to a new configuration to accommodate the needs of the user. However, these wall panel systems often require additional tools and fasteners for attachment of the frames and panels. The added equipment creates complex, difficult, and/or time consuming assembly and disassembly.

SUMMARY

According to an embodiment, a wall panel may include: a first upright post; a second upright post; a lower stretcher for connecting the first upright post to the second upright post; an upper stretcher for connecting the first upright post to the second upright post; at least one frame for placement within the first upright post, the second upright post, the lower stretcher, and the upper stretcher; and a first retractable latch located on the at least one frame, the first retractable latch adapted to engage at least one of the first upright post, second upright post, lower stretcher, or upper stretcher.

According to an embodiment, a wall panel system may include: at least one wall panel, the at least one wall panel comprising, a first upright post; a second upright post; a lower stretcher for connecting the first upright post to the second upright post; an upper stretcher for connecting the first upright post to the second upright post; at least one frame for placement within the first upright post, the second upright post, the lower stretcher, and the upper stretcher; a first retractable latch located on the at least one frame; and a second retractable latch located on the at least one frame.

According to an embodiment, a frame for a wall panel may include an upper surface, a lower surface, a first side surface, and a second side surface opposing the first side surface; a rail located on the upper surface; a trench located on the lower surface; and a first retractable latch and a second retractable latch.

According to an embodiment, a method of assembling a wall panel system may include: providing a first upright post; providing a second upright post; connecting a lower stretcher to the first upright post and to the second upright post; connecting an upper stretcher to the first upright post and to the second upright post; connecting at least one frame within the first upright post, the second upright post, the lower stretcher, and the upper stretcher using a first retractable latch.

BRIEF DESCRIPTION OF THE DRAWINGS

The foregoing aspects and other features and advantages of the invention will be apparent from the following drawings, wherein like reference numbers generally indicate identical, functionally similar, and/or structurally similar elements.

DETAILED DESCRIPTION

Embodiments of the invention are discussed in detail below. In describing embodiments, specific terminology is employed for the sake of clarity. However, the invention is not intended to be limited to the specific terminology so selected. A person skilled in the relevant art will recognize that other equivalent parts can be employed and other methods developed without departing from the spirit and scope of the invention. All references cited herein are incorporated by reference as if each had been individually incorporated.

Embodiments of the present invention relate to wall panels and wall panel systems which may be easily assembled and disassembled by one or more users with little or no fasteners or tools to achieve a custom workspace. Embodiments provide a plurality of wall panels which may be interconnected to form a wall panel system, thus allowing a large open area to be subdivided into individual and customized workspaces. The wall panel system may comprise frames having panels of varying materials, such as plastic, clear glass, frosted glass, and insulating foam, sound dampening material, fabric wrapped fiberglass, and medium density fiberboard (MDF), as desired by the user of each individual workspace. The panels may comprise one or more of the above listed materials, for example, the panels may include a MDF mounting board attached between two fabric wrapped fiberglass panels. The panels of material may be continuous within the frames. The frames may be quickly locked into a skeleton by spring-loaded latches in a "pop-in" manner. The latches may be retracted or depressed to allow for insertion of the frame into the skeleton. The latches may then be released to a position extending through slots in the skeleton to lock the frames into place. While the embodiments have been described with relation to workspaces, the apparatus and methods described herein may be used in any number of environments where an open space is desired to be customized.

Figure 1B:
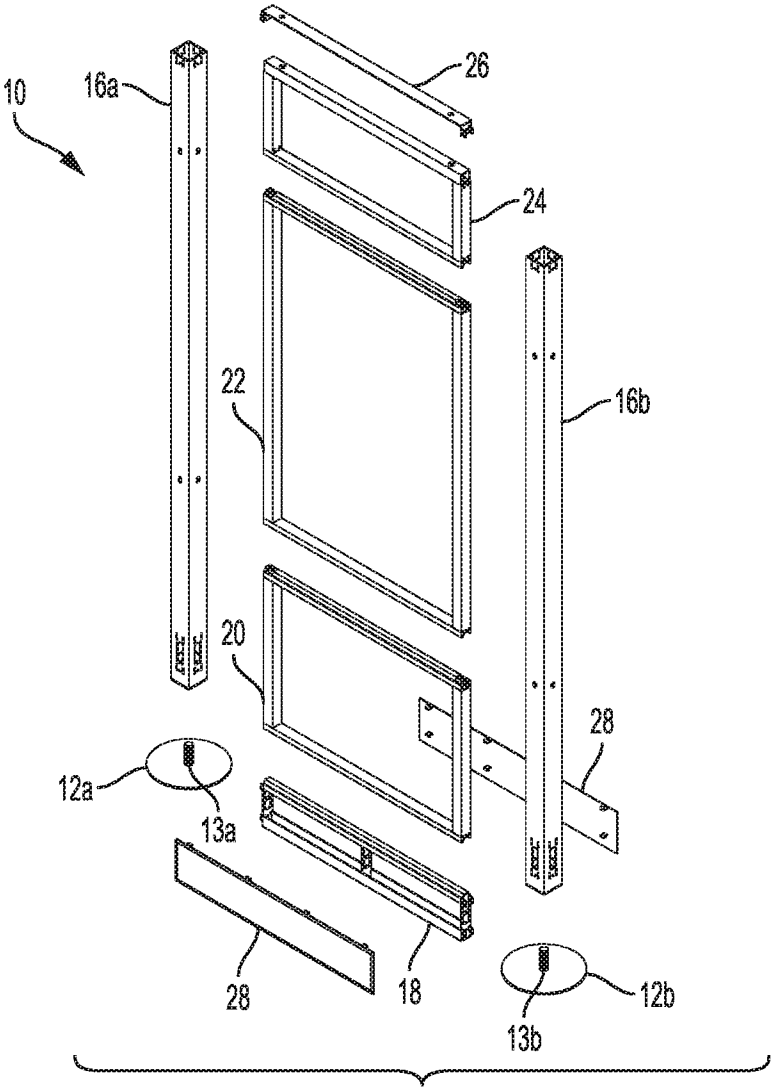
FIG. 1B is an exploded view of the assembled wall panel of FIG. 1A.
Figure 1A:
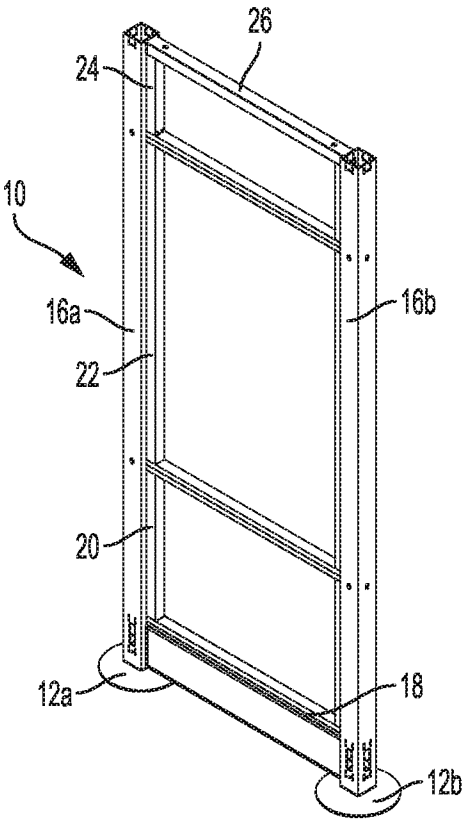
FIG. 1A is a perspective view of an assembled wall panel, according to an embodiment.

Referring to FIGS. 1A and 1B, an embodiment of a wall panel 10 according to the present invention is shown. Wall panel 10 may include base plates 12*a* and 12*b* comprising threaded posts 13*a*, 13*b* for connecting with posts 16*a* and 16*b*, respectively. The posts 16*a* and 16*b* may be substantially upright posts. Wall panel 10 may also include a lower stretcher 18, lower frame 20, middle frame 22, upper frame 24, and upper stretcher 26. According to embodiments, lower stretcher 18 may comprise a cable chase having a cover 28 on an outer surface, such as a front side and/or back side of the cable chase to enclose cables or wires which are routed through lower stretcher 18.

With continued reference to FIG. 1A, an embodiment of wall panel 10 is depicted in an assembled position. Posts 16*a* and 16*b* are connected to base plates 12*a* and 12*b*, respectively, via threaded posts 13*a*, 13*b*. Lower stretcher 18 and upper stretcher 26 are depicted in a releasably connected position with posts 16*a* and 16*b*. Together, lower stretcher 18, upper stretcher 26, first post 16*a*, and second post 16*b* form a skeleton of a wall panel 10. Within the skeleton, at least one frame may be placed during assembly of wall panel 10. As depicted in FIG. 1B, there may be three frames: a lower frame 20, a middle frame 22, and upper frame 24, however more or fewer frames are possible.

As will be discussed in more detail below, lower frame 20 may be placed on a rail of lower stretcher 18 and releasably locked in between posts 16*a* and 16*b*. Middle frame 22 may be placed on a rail of lower frame 20 and releasably locked in between posts 16*a* and 16*b*. Upper frame 24 may be placed on a rail of middle frame 22 and releasably locked in place between posts 16*a* and 16*b*. As can also be seen in FIG. 1B, lower stretcher 18 has openings through which cables or wires may pass. The lower stretcher 18 may have a cover 28 placed on an outer surface, such as a front and/or back side of the lower stretcher 18.

Lower frame 20, middle frame 22, and upper frame 24 may each support a panel (not shown) comprising any combination of plastic, clear glass, frosted glass, sound insulating foam, sound dampening material, fabric wrapped fiberglass, medium density fiberboard (MDF), and other desired wall panel materials. The panels may comprise one or more of the above listed materials, for example, the panels may include a MDF mounting board attached between two fabric wrapped fiberglass panels. The panel may be continuous within the frames. Base plates 12*a* and 12*b*, posts 16*a* and 16*b*, lower stretcher 18, upper stretcher 26, and covers 28 may be constructed of any combination of plastic, metal, aluminum, wood, composite, and other structurally supportive materials.

Figure 2B:
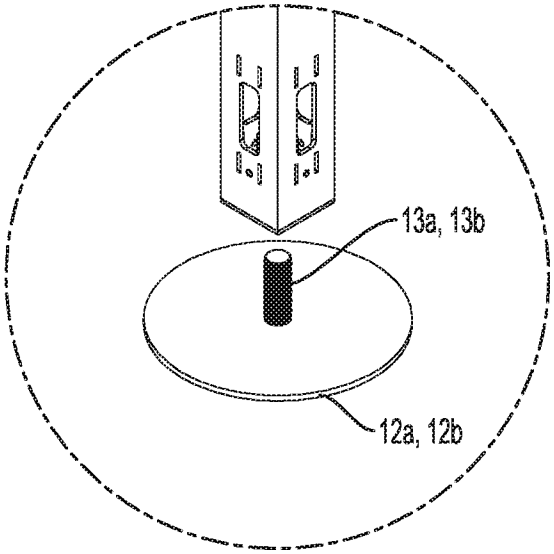
FIG. 2B is a detail view of a base plate of the wall panel of FIG. 1A.
Figure 2A:
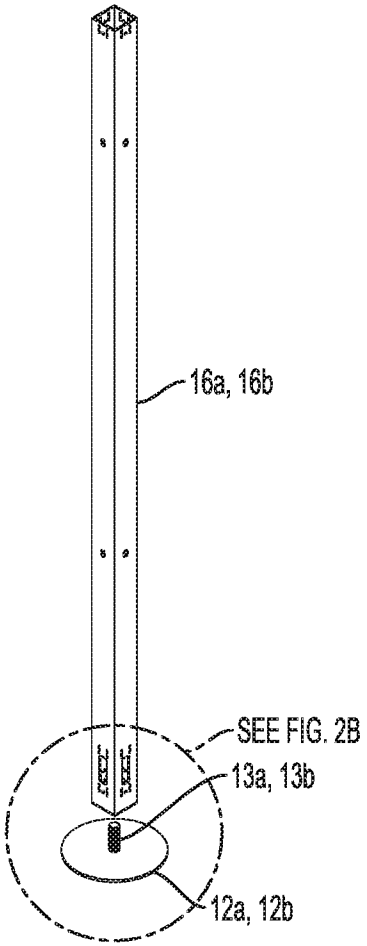
FIG. 2A is a perspective view of a post and base plate of the wall panel of FIG. 1A.

Referring to FIGS. 2A-2D, embodiments of a post 16*a*, 16*b* and base plate 12*a*, 12*b* are shown. Referring first to FIGS. 2A and 2B, base plates 12*a*, 12*b* may comprise threaded posts 13*a*, 13*b* that are received in threaded holes (not visible) in the bottom of posts 16*a*, 16*b*. During assembly of wall panel 10, threaded post 13*a* may be aligned with an opening in a lower end of post 16*a*. Base plate 12*a* or post 16*a* may be rotated to thread the threaded post 13*a* into the threaded hole of post 16*a*. This may secure the base plate 12*a* to the post 16*a*. The base plate 12*a* or the post 16*a* may be rotated to adjust the height of the post 16*a*. The threaded connection between base plate 12*a* and post 16*a* may allow for accommodation of uneven or non-level floors. The process may be repeated to connect base plate 12*b* with post 16*b*. During disassembly, the posts 16*a*, 16*b* or the base plates 12*a*, 12*b* may be rotated in a reverse direction to unthread the threaded posts 13*a*, 13*b* from the threaded holes in the posts 16*a*, 16*b*.

Figure 2D:
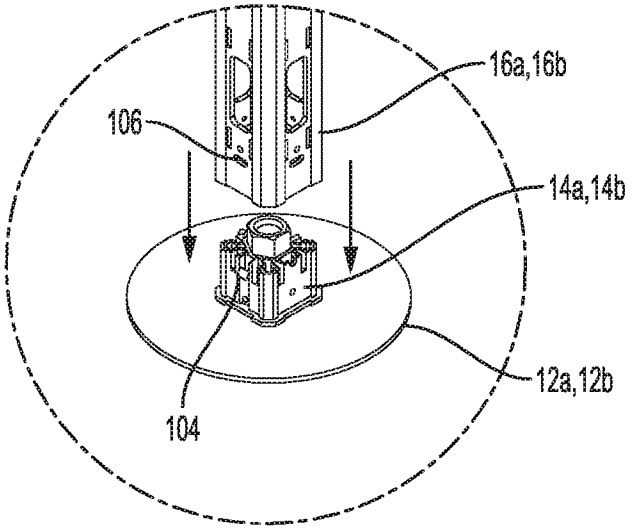
FIG. 2D is a detail view of the alternative base plate of FIG. 2C.
Figure 2C:
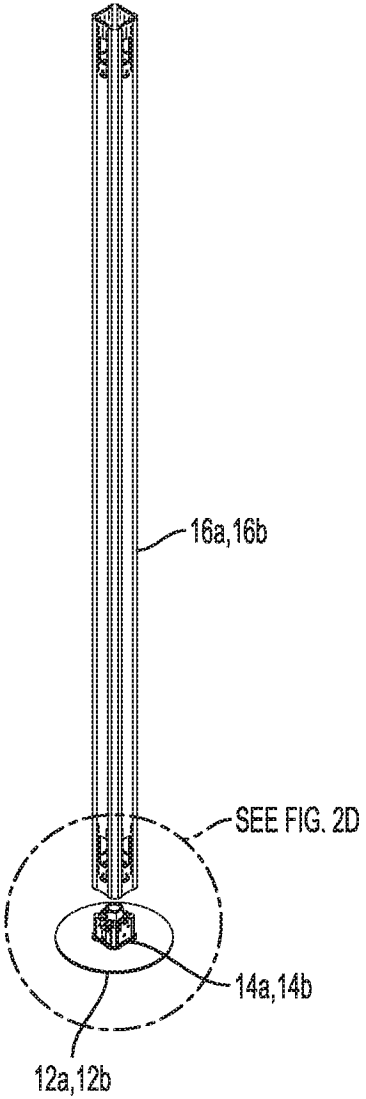
FIG. 2C is a perspective view of an alternative post and base plate of the wall panel of FIG. 1A.

Referring now to FIGS. 2C and 2D, an alternative embodiment incorporating blocks 14*a*, 14*b* is shown. FIG.

2D shows blocks 14*a* and 14*b* may include a latch 104 which may fit into an opening 106 on posts 16*a* and 16*b*. A similar latch 104 may be located on the opposing side of blocks 14*a* and 14*b*, or may be located on all four sides of blocks 14*a* and 14*b*. During assembly of wall panel 10, block 14*a* of base plate 12*a* is aligned with an opening in a lower end of post 16*a*. Post 16*a* may then be lowered onto block 14*a*, depressing the latch (or latches) 104 due to contact with the inner surface of the post 16*a* until the latch 104 is aligned with the opening 106. Once aligned, the latch 104 may extend through opening 106 to latch the post 16*a* to the block 14*a*. The process is repeated to connect base plate 12*b* with post 16*b*. During disassembly, a user may depress the latch 104 on block 14*a*, manually or with a tool (such as a flathead screw driver), and once depressed, the post 16*a* may be raised until the bottom of the post 16*a* has exited block 14*a*. The process is repeated to disassemble base plate 12*b* from post 16*b*.

Alternative structures for providing connection between base plates 12*a* and 12*b* and posts 16*a* and 16*b* may be provided. The connections may allow for height adjustability of the posts 16*a* and 16*b*.

Figure 3C:
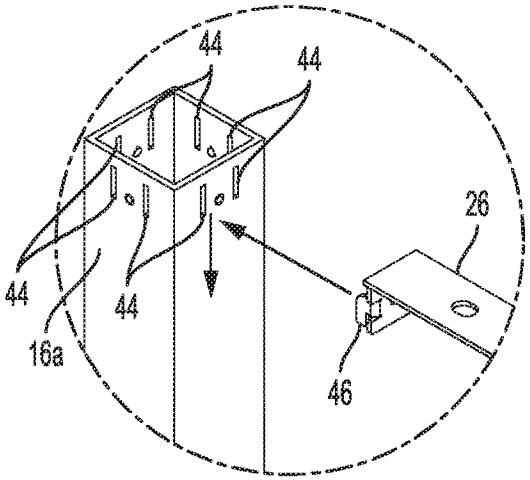
FIG. 3C is a detail view of a connection between an upper stretcher and a post of the wall panel of FIG. 1A.
Figure 3B:
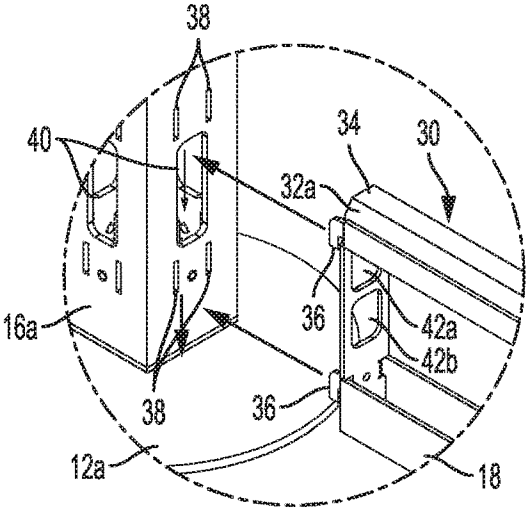
FIG. 3B is a detail view of a connection between a lower stretcher and a post of the wall panel of FIG. 1A.
Figure 3A:
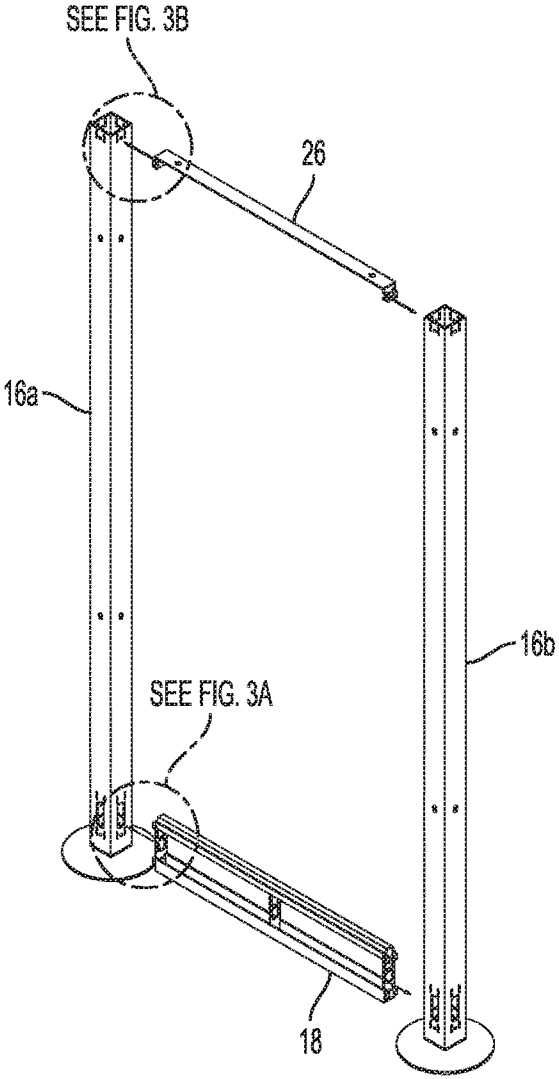
FIG. 3A is a perspective view of installation of an upper stretcher and lower stretcher of the wall panel of FIG. 1A.

Referring to FIG. 3A, lower stretcher 18 may be connected between post 16*a* and post 16*b*. Upper stretcher 26 may be connected between post 16*a* and post 16*b*. Together, lower stretcher 18, upper stretcher 26, first post 16*a*, and second post 16*b* form a skeleton of a wall panel 10.

Referring to FIG. 3B, a connection between lower stretcher 18 and post 16*a* is shown. The upper surface of lower stretcher 18 may comprise a rail 30. Rail 30 may be designed with an upper surface having a generally horizontal surface 34 coupling a first angled surface 32*a* to a second angle surface (not visible). The second angled surface may be the same or similar to the first angled surface 32*a* except that the second angled surface extends from the generally horizontal surface 34 to produce a mirror image of the first angled surface 32*a*. That is, a side profile of the rail 30 may produce a generally trapezoidal shape, such as, for example, rail 50 of FIG. 5D. Lower stretcher 18 may also comprise hooks 36, for example, downward facing hooks.

Referring again to FIG. 3B, post 16*a* may include slots 38 for receiving hooks 36 of lower stretcher 18. Though four slots 38 and hooks 36 are depicted, more or less may be employed. During installation, hooks 36 are aligned with slots 38 of post 16*a*. Corresponding hooks 36 on the opposing end of lower stretcher 18 (seen in FIG. 3A) are aligned with slots 38 of post 16*b*. With both sets of hooks 36 aligned with slots 38 on posts 16*a* and 16*b*, lower stretcher 18 is displaced downward to secure hooks 36 in slots 38.

With continued reference to FIG. 3B, post 16*a* may also include openings 40. Corresponding openings 42*a* and 42*b* on lower stretcher 18 may align with openings 40 on post 16*a*. The arrangement of aligned openings allows for receiving and routing cables or wires throughout the wall panel system. The opposing end of lower stretcher 18 may have corresponding openings 42*a* and 42*b* which may be aligned with openings 40 on post 16*b*. Thus, a continuous path from post 16*a* through lower stretcher 18 to post 16*b* may be provided. The continuous path may allow for cables or wires to be routed through the wall panel 10. When multiple wall panels 10 are installed to form a longer wall, a cubical, a room, etc., a network of cable paths may be achieved through openings 40, 42*a*, and 42*b*. Lower stretcher 18 and posts 16*a*, 16*b* may provide a cable management system that allows wires or cables, such as power or signal cables, to be routed through the openings 40, 42*a*, 42*b*. The wires or cables may couple to electrical outlets, Ethernet ports, auxiliary ports, communications ports, and other known connections for power and signal cables provided in the lower stretcher 18 or within one of the frames. Thus, devices may be coupled to the cables within the cable management system. Thus a workspace created by the described quick wall system may allow for the connection of one or more devices to one or more cables routed within the cable management system. The devices (such as computers, phones, printers, televisions, audio equipment, and other electronic devices) may thus be placed in the individual, subdivided workspaces and couple to the wires or cables which are routed through the quick wall system to a main power, electrical, or data source. The cable management system described may also allow routing the cables vertically through the interior of posts 16*a* and 16*b*, for example, routing the cables from the upper stretcher 26 to the lower stretcher 18 or to a location in between, such as a location along a frame.

Referring to FIG. 3C, a connection between upper stretcher 26 and post 16*a* is shown. Post 16*a* may include slots 44 for receiving hooks 46 of upper stretcher 26, for example, downward facing hooks. Though two slots 44 and hooks 46 are depicted, more or less may be employed. During installation, hooks 46 are aligned with slots 44 of post 16*a*. Corresponding hooks 46 on the opposing end of upper stretcher 26 are aligned with slots 44 on post 16*b*. With both sets of hooks 46 aligned with slots 44 on posts 16*a* and 16*b*, upper stretcher 26 is displaced downward to secure hooks 46 in slots 44.

Upper stretcher 26 may be designed similar to lower stretcher 18 such that upper stretcher 26 may be part of the management system that allows cables, such as power or signal cables, to be routed through the openings. Electrical outlets, Ethernet ports, auxiliary ports, communications ports, and other known connections for power and signal cables may be provided in the upper stretcher 26 or within one of the frames. The connections may allow for devices to be coupled to the cables routed within the cable management system.

Figure 4B:
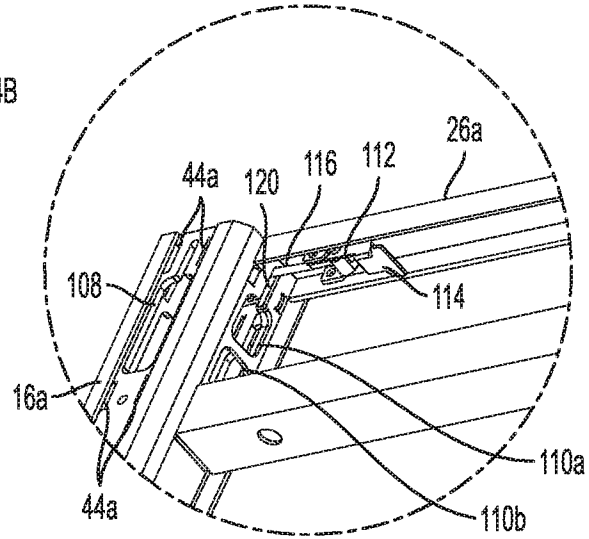
FIG. 4B is a detail view of a connection between an alternative upper stretcher and a post of the wall panel of FIG. 4A.
Figure 4A:
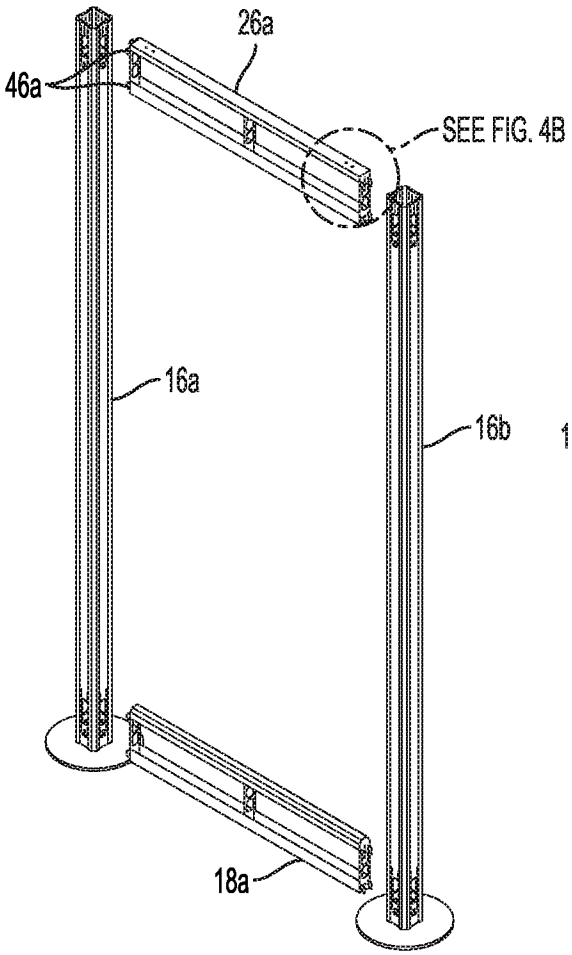
FIG. 4A is a perspective view of installation of an alternative upper stretcher and lower stretcher of the wall panel of FIG. 1A.

Referring to FIG. 4A, an alternative embodiment of the upper stretcher 26*a* is shown. Lower stretcher 18*a* may be connected between post 16*a* and post 16*b*. Upper stretcher 26*a* may be connected between post 16*a* and post 16*b*. Together, lower stretcher 18*a*, upper stretcher 26*a*, first post 16*a*, and second post 16*b* form a skeleton of a wall panel 10.

Referring to FIG. 4B, a connection between upper stretcher 26*a* and post 16*a* is shown. Post 16*a* may comprise slots 44*a* for receiving hooks 46*a* (See FIG. 4A) of upper stretcher 26*a*, for example, downward facing hooks. Though four slots 44*a* and hooks 46*a* are depicted, more or less may be employed. During installation, hooks 46*a* are aligned with slots 44*a* of post 16*a*. Corresponding hooks 46*a* on the opposing end of upper stretcher 26*a* are aligned with slots 44*a* on post 16*b*. With both sets of hooks 46*a* aligned with slots 44*a* on posts 16*a* and 16*b*, upper stretcher 26 is displaced downward to secure hooks 46*a* in slots 44*a*.

Figure 4C:
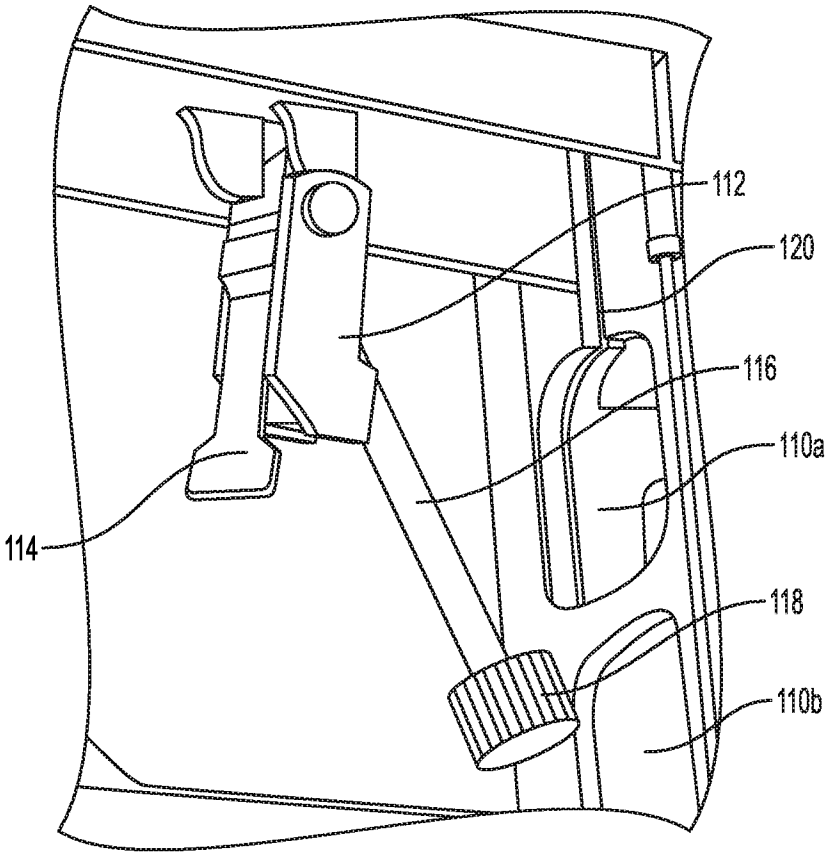
FIG. 4C is a detail view of a draw latch of the alternative upper stretcher of FIG. 4A.

Referring again to FIG. 4B, a draw latch 112 may be provided on upper stretcher 26*a*. The opposing end of upper stretcher 26*a* may have a corresponding draw latch 112. Draw latch 112 may be provided in addition to, or as an alternative to, hooks 46*a* and slots 44*a*. Referring to FIGS. 4B and 4C, draw latch 112 may be moved from a disengaged position, where rod 116 and foot 118 are not engaged with slot 120 and opening 110*a* to the engaged position of FIG. 4B. A flange 114 may be pivotally connected to a surface of the upper stretcher 26*a*. Referring to FIG. 4C, a rod 116 may be pivotally connected to the flange 114 and a foot 118 may be provided on an end of rod 116. To engage the draw latch 112, the foot 118 and rod 116 may be inserted into opening 110*a* and guided upward through slot 120. Holding rod 116 in place, an end of flange 114 may be depressed to retract the rod 116 to secure the foot 118 in place behind the slot 120, thereby securing the upper stretcher 26*a* to the post 16*a*.

Draw latch 112 may also be provided on lower stretcher 18*a*. Draw latch 112 may be provided on opposing longitudinal ends of lower stretcher 18*a*. Draw latch 112 may also be provided with the embodiment of FIG. 3A. That is, draw latch 112 may be provided on one or both of upper stretcher 26 and lower stretcher 18. Draw latch 112 may be provided on opposing longitudinal ends of lower stretcher 18 and/or upper stretcher 26.

Referring to FIG. 4B, post 16*a* may also include openings 108. Corresponding openings 110*a* and 110*b* on upper stretcher 26*a* may align with openings 108 on post 16*a*. The arrangement of aligned openings allows for receiving and routing cables or wires throughout the wall panel system. The opposing end of upper stretcher 26*a* may have corresponding openings 110*a* and 110*b* which may be aligned with openings 108 on post 16*b*. Thus, a continuous path from post 16*a* through upper stretcher 26*a* to post 16*b* may be provided. A person of skill in the art will recognize that when multiple wall panels 10 are installed, a network of cable paths is achieved through openings 108, 110*a*, and 110*b*. Upper stretcher 26*a* provides a cable management system that allows cables, such as power or signal cables, to be routed through the openings. Electrical outlets, Ethernet ports, auxiliary ports, communications ports, and other known connections for power and signal cables may be provided in the upper stretcher 26*a* or within one of the frames to allow for connection of devices to cables routed within the cable management system. Additionally, the cable management system described may further allow routing the cables through the interior of posts 16*a* and 16*b*.

Figures 5A, 5B, 5C, 5D:
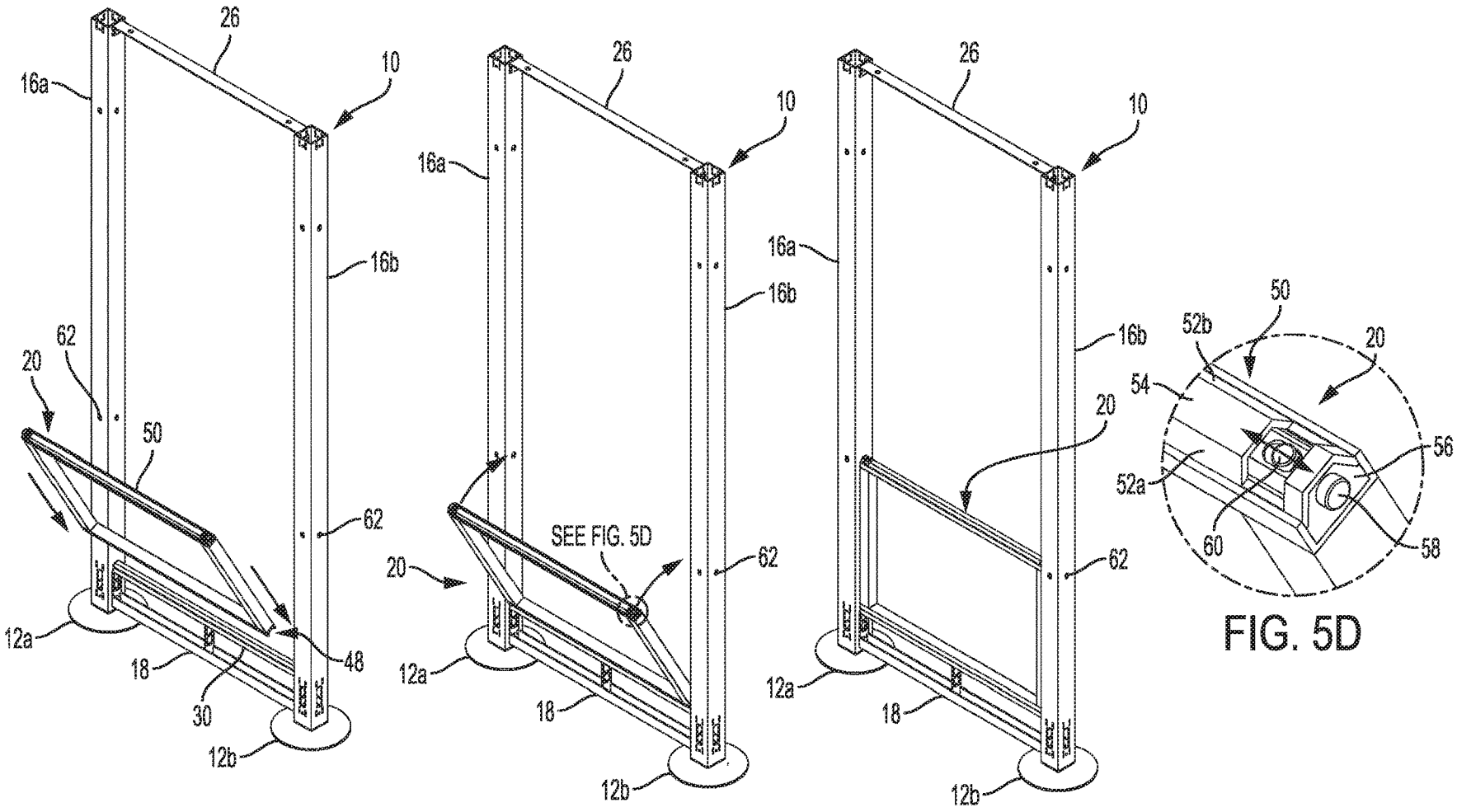
FIGS. 5A, 5B, and 5C are perspective views depicting an illustrative sequence of installation of a lower frame of the wall panel of FIG. 1A.
FIG. 5D is a detail view of a rail and latch on a lower frame of the wall panel of FIG. 5B.

Referring to FIGS. 5A, 5B, and 5C, installation of lower frame 20 is shown. Lower frame 20 may have a trench 48 which may be placed on rail 30 of lower stretcher 18. Lower frame 20 may also comprise a rail 50 on an upper end. Trench 48 is generally concave as can be seen in FIG. 5A. In some embodiments, trench 48 may have a profile corresponding to the profile of the rail 30. That is, trench 48 may have two angled surfaces connected by a generally horizontal surface. The two angled surfaces of trench 48 may mate with the two angled surfaces of rail 30 (FIG. 3B). The generally horizontal surface of the trench 48 may mate with generally horizontal surface 34 of rail 30 (FIG. 3B). The angled surfaces may engage on opposite sides of the horizontal surface 34 of rail 30. The mating of the surfaces of trench 48 and rail 30 hold the lower frame 20 on the lower stretcher 18. Although the discussed geometry comprises angled surfaces connected by a generally horizontal surface, other mating geometries are possible. For example, the trench may take a shape that is generally triangular, semicircular, square, rectangular, curved, or other geometry. Similarly, the rail may then take a sufficiently corresponding shape to mate with the geometry of the trench.

Referring to FIG. 5D, rail 50 is shown in more detail. Rail 50 may be designed with an upper surface having two angled surfaces 52*a* and 52*b* connected by a generally horizontal surface 54. Extending from a side surface 56 of rail 50 is a spring-loaded latch 58 (spring not depicted). Slide 60 may be moved inward toward the center of lower frame 20 to retract latch 58 (e.g. against the force of the spring) and may be released or moved outward toward the edge of lower frame 20 to release latch 58. The opposing side of lower frame 20 may have a second latch 58 extending from a second side surface 56 and actuated by a second slide 60.

Referring again to FIG. 5A, trench 48 of lower frame 20 may be positioned on rail 30 of lower stretcher 18. As discussed, trench 48 may have a generally concave shape to mate with the rail 30. Slides 60 may be moved inward toward the center of lower frame 20 to retract latches 58. The slides 60 may be moved inward simultaneously or substantially simultaneously. As seen in FIG. 5B, lower frame 20 may then be pivoted upward to a substantially vertical or upright position. With slides 60 still pressed inward, latches 58 may be aligned with slots 62 on posts 16*a* and 16*b*. Once aligned, slides 60 may be released or moved outward such that latches 58 are extended outward (e.g. due to the spring force) and into slots 62. The slides 60 may be released or moved outward simultaneously or substantially simultaneously. Referring to FIG. 5C, latches 58 are in their extended position in engagement with slots 62 and lower frame 20 is in the installed and releasably locked position. Although two of each of latches 58, slides 60, and slots 62 are depicted; one of each of latch 58, slide 60, and slot 62 may be provided. Alternatively, more than two of each of latches 58, slides 60, and slots 62 may be provided.

Although lower frame 20 is described as being placed on rail 30 and pivoted upward to a substantially vertical or upright position, other methods of assembly are possible. For example, lower frame 20 may be initially placed in a substantially vertical or upright position and angled through an opening provided between posts 16*a* and 16*b* such that lower frame 20 slides into the opening and onto rail 30, remaining in a substantially vertical position during assembly. Alternatively, lower frame 20 may be placed such that rail 50 is placed within trench 64 of middle frame 22 and then pivoted downward into a substantially vertical or upright position. Alternatively, rail 30 and/or trench 48 may be located on one or both side surfaces of the lower frame 20 with a corresponding rail and/or trench located on post 16*a* and/or 16*b*, such that lower frame 20 slides into an installed location mating with a surface or surfaces on posts 16*a* and/or 16*b*. In such an embodiment, latches 58 and/or slides 60 may be located on the upper surface, as previously described, or on one of the side surfaces.

Figure 6C:
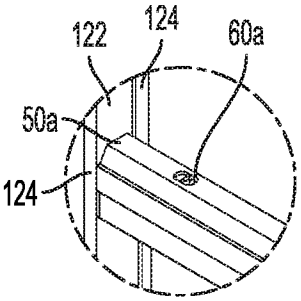
FIG. 6C is a detail view of a latch on a lower frame of the wall panel of FIG. 6A.
Figure 6B:
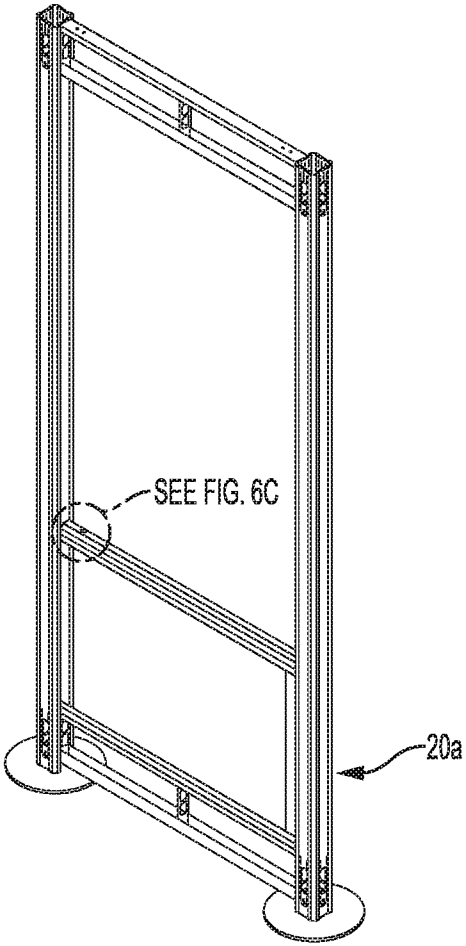
FIGS. 6A and 6B are perspective views depicting an illustrative sequence of installation of an alternative lower frame of the wall panel of FIG. 1A.
Figure 6A:
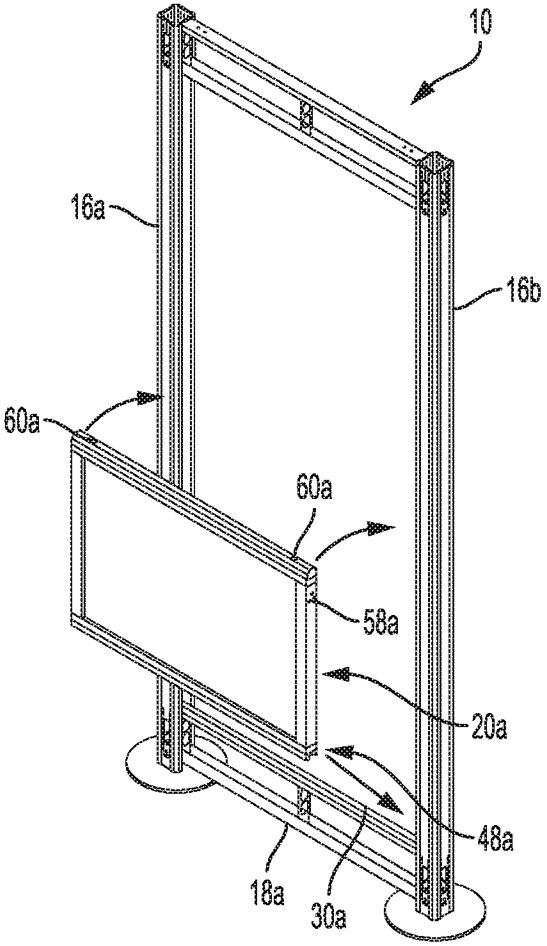

An alternative embodiment is shown in FIGS. 6A-6C. Lower frame 20*a* may have a trench 48*a* which may be positioned on rail 30*a* of lower stretcher 18*a*. Lower frame 20*a* may also comprise a rail 50*a* on an upper end. Trench 48*a* and rail 30*a* may be substantially the same as trench 48 and rail 30 in the FIGS. 5A-5C. Trench 48*a* and rail 30*a* may have mating surfaces such as those described with relation to FIGS. 5A-5C. Located on side surfaces of lower frame 20*a* are latches 58*a*. The latches 58*a* may be the same or similar to latches 58 of FIGS. 5A-5C. Any number of latches may be used, including a single latch. The single latch may be elongated such that it spans substantially the width of the side surface of lower frame 20*a* Similarly, multiple latches may be elongated to span substantially the width of the side surface of lower frame 20*a* and then may be stacked in a generally vertical manner. The opposing side of lower frame 20*a* may have a second set of latches 58*a* extending from a second side surface.

Referring to FIG. 6A, trench 48*a* of lower frame 20*a* may be positioned on rail 30*a* of lower stretcher 18*a*. As discussed, trench 48*a* may have a generally concave shape to mate with the rail 30*a*. Lower frame 20*a* may then be pivoted upward to a substantially vertical or upright position. The latches 58*a* may depress (e.g. against the force of a spring) when they come into contact with a raised portion 124 (FIG. 6C) of the post 16*a*. As the lower frame 20*a* is moved from contact with the raised portion 124 to the substantially vertical or upright position of FIG. 6B, the latches 58*a* may extend (e.g. due to the springs extending) into the reduced portion 122 of the post 16*a*. The latches 58*a*, now extended into the reduced portion 122 will maintain the lower frame 20*a* in the assembled position due to the raised portions 124 which will not allow the latches 58*a* to pass. To remove the lower frame 20*a*, the slide 60*a* (FIG. 6C) may be moved inward simultaneously or substantially simultaneously with a second slide 60*a* on an opposing side of lower frame 20*a*. Movement of the slides 60*a* inward will cause the latches 58*a* to depress and allow the lower frame 20*a* to be disassembled from the posts 16*a* and 16*b*.

Figures 7A, 7B, 7C, 7D:
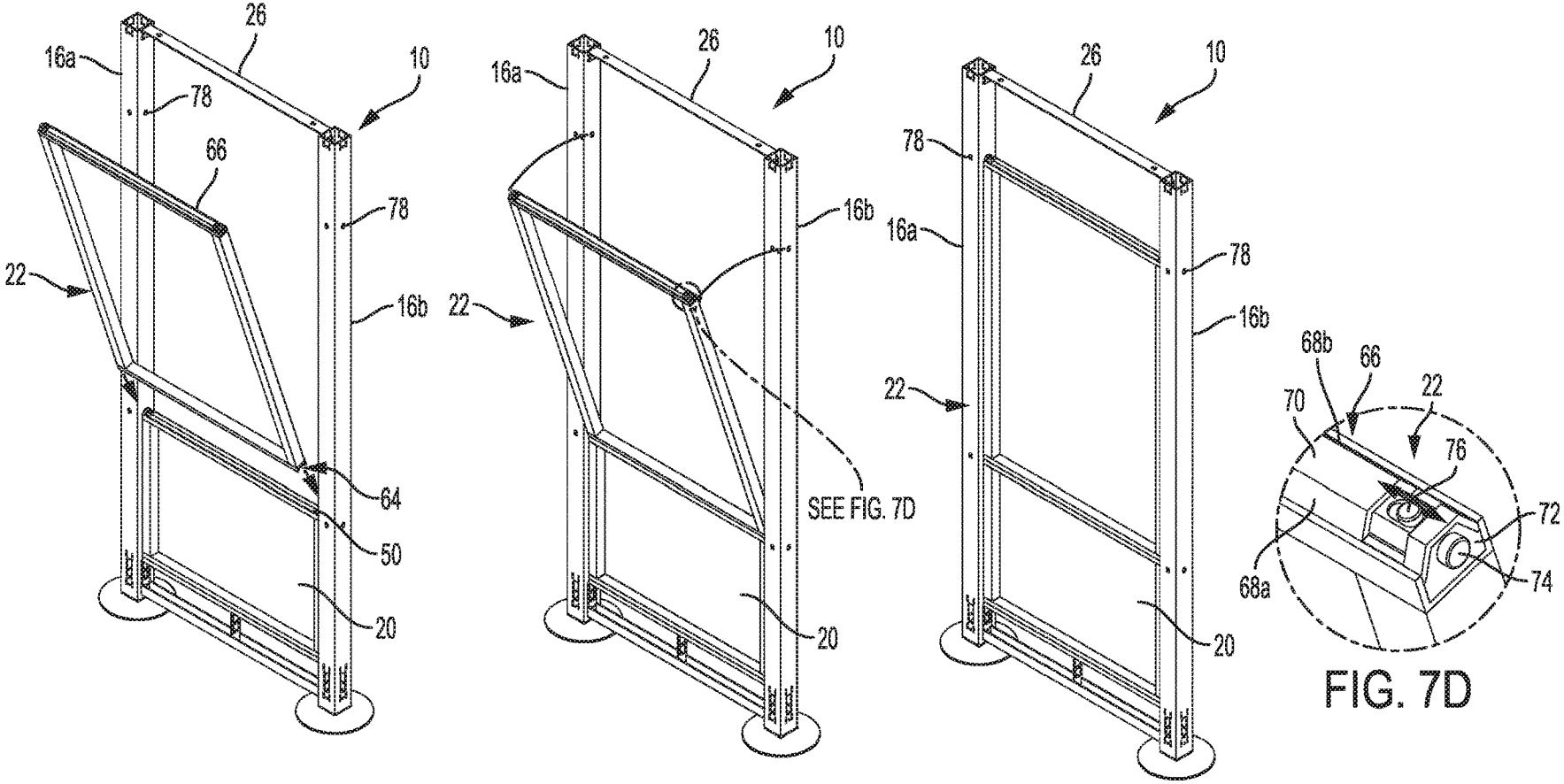
FIGS. 7A, 7B, and 7C are perspective views depicting an illustrative sequence of installation of a middle frame of the wall panel of FIG. 1A.
FIG. 7D is a detail view of a rail and latch on a middle frame of the wall panel of FIG. 7B.

Referring to FIGS. 7A, 7B, and 7C, installation of middle frame 22 is shown. Middle frame 22 may have a trench 64 which may be placed on rail 50 of lower frame 20. Middle frame 22 may also comprise a rail 66 on an upper end. Trench 64 is generally concave as can be seen in FIG. 7A. In some embodiments, trench 64 may have a profile corresponding to the profile of the rail 50. That is, trench 64 may have two angled surfaces connected by a generally horizontal surface. The two angled surfaces of trench 64 may mate with the two angled surfaces 52*a* and 52*b* of rail 50 (FIG. 5D). The generally horizontal surface of the trench 64 may mate with generally horizontal surface 54 of rail 50 (FIG. 5D). The angled surfaces may engage on opposite sides of the horizontal surface 54 of rail 50 (FIG. 5D). The mating of the surfaces of trench 64 and rail 50 hold the middle frame 22 on the lower frame 20. Though the discussed geometry comprises angled surfaces connected by a generally horizontal surface, other mating geometries are possible. For example, the trench may take a shape that is generally triangular, semicircular, square, rectangular, curved, or other geometry. Similarly, the rail may then take a sufficiently corresponding shape to mate with the geometry of the trench.

Referring to FIG. 7D, rail 66 is shown in more detail. As can be seen, rail 66 may be similar to rail 50 of lower frame 20. Rail 66 may be designed with an upper surface having two angled surfaces 68*a* and 68*b* connected by a generally horizontal surface 70. Extending from a side surface 72 of rail 66 is a spring-loaded latch 74 (spring not depicted). Slide 76 may be moved inward by a user toward the center of middle frame 22 to retract latch 74 (e.g. against the force of the spring) and may be released or moved outward toward the edge of middle frame 22 to release latch 74. The opposing side of middle frame 22 may have a second latch 74 extending from a second side surface 72 and actuated by a second slide 76.

Referring again to FIG. 7A, the trench 64 of middle frame 22 may be positioned on rail 50 of lower frame 20. As discussed, trench 64 may have a generally concave shape to mate with the rail 50. During assembly, the slides 76 may be moved inward by a user toward the center of middle frame 22 to retract latches 74. The slides 76 may be moved inward simultaneously or substantially simultaneously. As seen in FIG. 7B, middle frame 22 may then be pivoted upward to a substantially vertical or upright position. With the slides 76 still pressed inward, latches 74 are aligned with slots 78 on posts 16*a* and 16*b*. Once aligned, slides 76 are released or moved outward such that latches 74 are extended outward (e.g. due to the spring force) and into slots 78. The slides 76 may be release or moved outward simultaneously or substantially simultaneously. Referring to FIG. 7C, latches 74 are in their extended position in engagement with slots 78 and middle frame 22 is in the installed and locked position. Although two of each of latches 74, slides 76, and slots 78 are depicted (see FIG. 7C), one of each of latch 74, slide 76, and slot 78 may be provided. Alternatively, more than two of each of latches 74, slides 76, and slots 78 may be provided.

Although middle frame 22 is described as being placed on rail 50 and pivoted upward to a substantially vertical or upright position, other methods of assembly are contemplated by the invention. For example, middle frame 22 may be initially placed in a substantially vertical or upright position and angled through an opening provided between posts 16*a* and 16*b* such that middle frame 22 slides into the opening and onto rail 50, remaining in a substantially vertical position during assembly. Alternatively, middle frame 22 may be placed such that rail 66 is placed within trench 80 of upper frame 24 and then pivoted downward into a substantially vertical or upright position. Alternatively, rail 50 and/or trench 64 may be located on one or both side surfaces of the middle frame 22 with a corresponding rail and/or trench located on post 16*a* and/or 16*b*, such that middle frame 22 slides into an installed location mating with a surface or surfaces on posts 16*a* and/or 16*b*. In such an embodiment, latches 74 and/or slides 76 may be located on the upper surface, as previously described, or on one of the side surfaces.

Figure 8D:
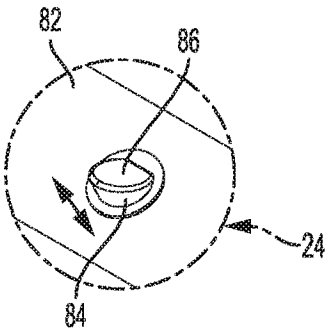
FIG. 8D is a detail view of a latch on an upper frame of the wall panel of FIG. 8B.
Figure 8E:
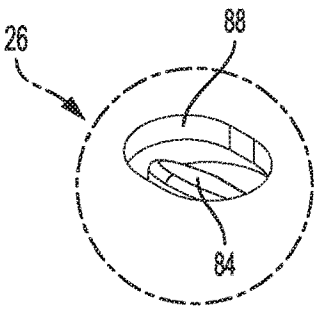
FIG. 8E is a detail view of a latch receiver on an upper stretcher of the wall panel of FIG. 8C.
Figure 8C:
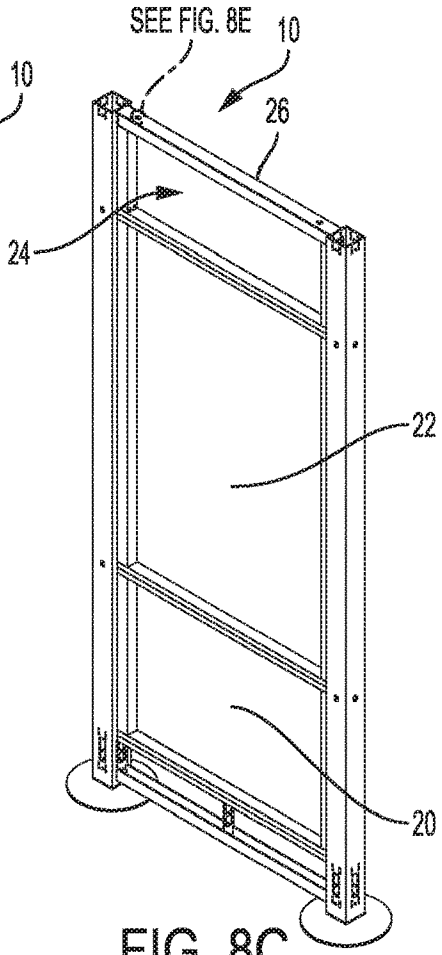
FIGS. 8A, 8B, and 8C are perspective views depicting an illustrative sequence of installation of an upper frame of the wall panel of FIG. 1A.
Figure 8B:
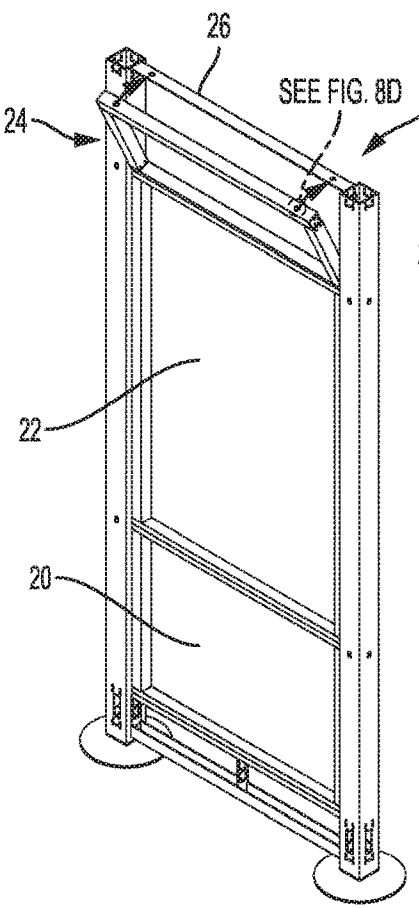
Figure 8A:
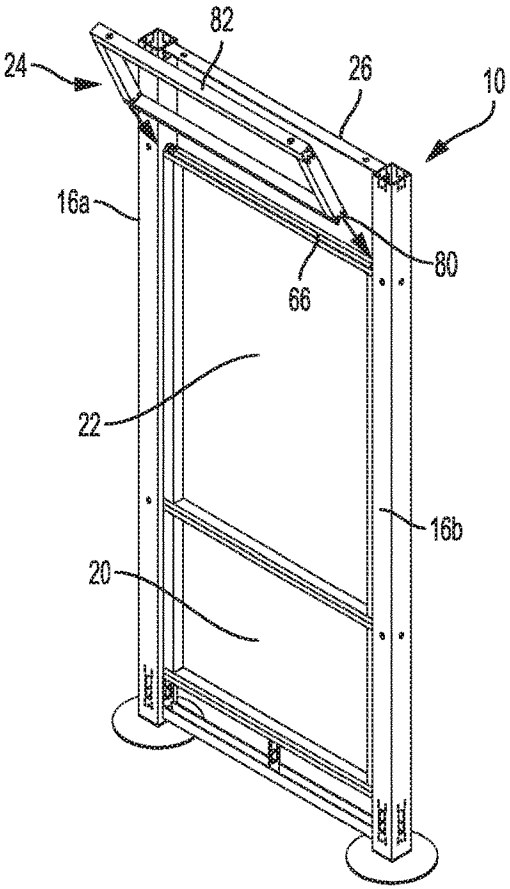

Referring to FIGS. 8A, 8B, and 8C, installation of upper frame 24 is shown. Upper frame 24 may have a trench 80 which may be placed by a user on rail 66 of middle frame 22. Trench 80 is generally concave as can be seen in FIG. 8A. In some embodiments, trench 80 may have a profile corresponding to the profile of the rail 66. That is, trench 80 may have two angled surfaces connected by a generally horizontal surface. The two angled surfaces of trench 80 may mate with the two angled surfaces 68*a* and 68*b* of rail 66. The generally horizontal surface of the trench 80 may mate with generally horizontal surface 70 of rail 66. The angled surfaces may engage on opposite sides of the horizontal surface 70 of rail 66. The mating of the surfaces of trench 80 and rail 66 hold the upper frame 24 on the middle frame 22. Though the discussed geometry comprises angled surfaces connected by a generally horizontal surface, other mating geometries are possible. For example, the trench may have a shape that is generally triangular, semicircular, square, rectangular, or other geometry. Similarly, the rail may then have a corresponding shape to mate with the geometry of the trench.

Referring to FIG. 8D, upper frame 24 may comprise a top surface 82. Top surface 82 is shown with latch 84, biased toward an upward position (e.g. by a spring). Latch 84 comprises angled surface 86. FIG. 8E depicts slot 88 on upper stretcher 26 for receiving latch 84. Referring back to FIGS. 8A-8C, a second latch 84 and second slot 88 may be seen on an opposing side of upper frame 24 and upper stretcher 26, respectively. Though two of each of latches 84 and slots 88 are depicted, one of each of latch 84 and slot 88 may be provided. Alternatively, more than two of each of latches 84 and slots 88 may be provided.

Referring again to FIG. 8A, during assembly, the trench 80 of upper frame 24 is located on rail 66 of middle frame 22. As discussed, trench 80 may have a generally concave shape to mate with the rail 66. Upper frame 24 is positioned on rail 66 such that angled surfaces 86 are facing toward wall panel 10 and upper stretcher 26. As depicted in FIG. 8B, upper frame 24 is pivoted upward to a substantially vertical or upright position. During movement of upper frame 24, angled surfaces 86 will come into contact with a lower surface of upper stretcher 26. The contact of the lower surface with the angled surfaces 86 will cause latches 84 to depress (e.g. against the force of the spring). When latches 84 reach slots 88 in upper stretcher 26, the force on angled surface 86 will be released and latches 84 will extend through slots 88 (e.g. due to the springs extending). Referring to FIG. 8C, latches 84 are in the extended position through slots 88 and upper frame 24 is in the installed and locked position.

Although upper frame 24 is described as being placed on rail 66 and pivoted upward to a substantially vertical or upright position, other methods of assembly are contemplated by the invention. For example, upper frame 24 may be initially placed in a substantially vertical or upright position and angled through an opening provided between posts 16*a* and 16*b* such that upper frame 24 slides into the opening and onto rail 66, remaining in a substantially vertical position during assembly. Alternatively, upper frame 24 may be placed such that top surface 82 is placed in contact with the lower surface of upper stretcher 26 and then pivoted downward into a substantially vertical or upright position. Alternatively, trench 80 or a rail may be located on one or both side surfaces of the upper frame 24 with a corresponding rail and/or trench located on post 16*a* and/or 16*b*, such that upper frame 24 slides into an installed location mating with a surface or surfaces on posts 16*a* and/or 16*b*. In such an embodiment, latches 84 may be located on the upper surface, as previously described, or on one of the side surfaces. Once constructed, the wall panel 10 may be disassembled by reversing the order of assembly, as is described in more detail to follow.

A feature of the present invention is the ability to easily deconstruct wall panel 10. To remove upper frame 24, latches 84 are depressed (e.g., by pressing through the slots 88 to contact latches 84) and upper frame 24 is pivoted from the substantially vertical position downward until upper frame 24 is no longer in engagement with upper stretcher 26. To remove middle frame 22, slides 76 are moved inward toward the center of middle frame 22 to retract latches 74. Middle frame 22 is pivoted from the substantially vertical position downward until latches 74 are no longer in engagement with posts 16*a* and 16*b*. Lower frame 20 is removed in a similar manner. Slides 60 are moved inward toward the center of lower frame 20 to retract latches 58. Lower frame 20 is pivoted from the substantially vertical position downward until latches 58 are no longer in engagement with posts 16*a* and 16*b*.

To remove upper stretcher 26, an upward force is applied to the upper stretcher 26 to disengage hooks 46 from slots 44. To remove lower stretcher 18, an upward force is applied to the lower stretcher 18 to disengage hooks 36 from slots 38. According to embodiments having blocks 14*a*, 14*b*, to remove posts 16*a*, 16*b* from base plates 12*a*, 12*b*, base plate 12*a*, 12*b* is held in place while an upward force is applied to post 16*a*, 16*b* to disengage the block 14*a*, 14*b* from the respective post 16*a*, 16*b*.

Figure 9B:
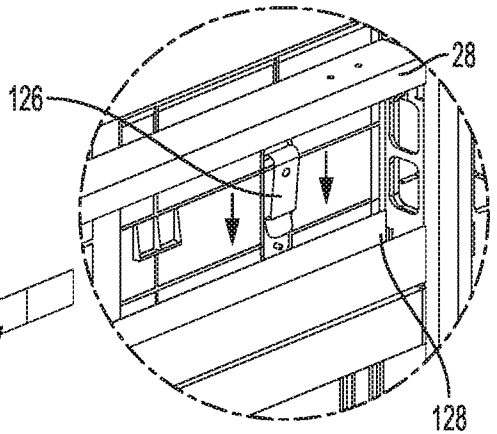
FIG. 9B is a detail view of the covers of the wall panel of FIG. 9A.
Figure 9A:
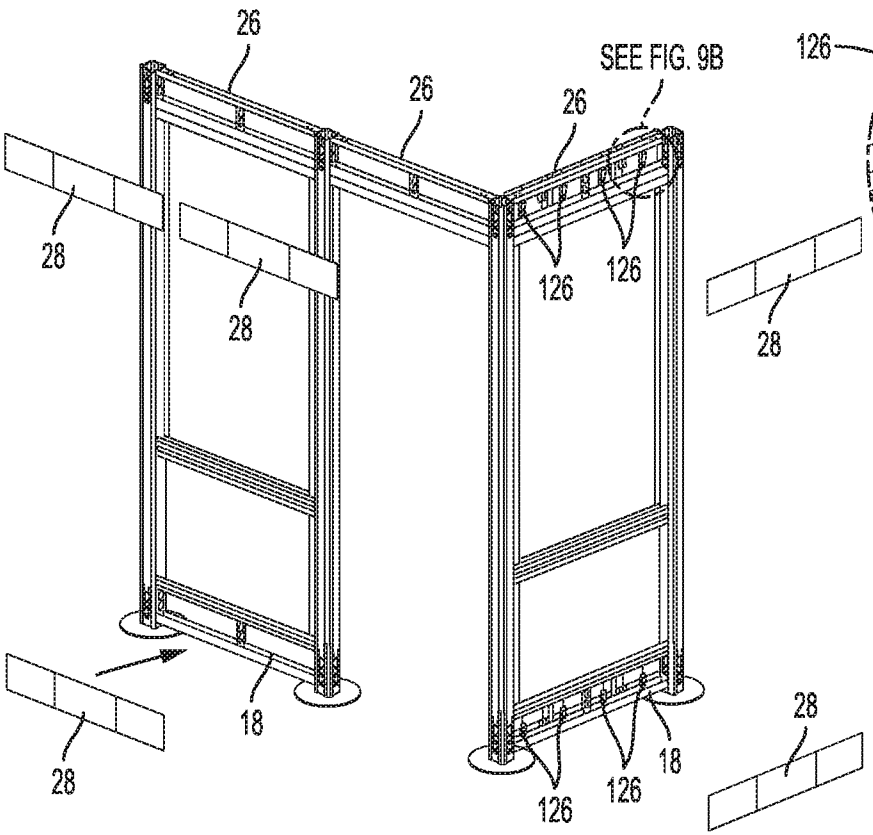
FIG. 9A is a perspective view of covers for a wall panel of FIG. 1A.

Referring to FIGS. 9A and 9B, a cover 28 may be provided on an outer surface of lower stretcher 18 or upper stretcher 26. As shown in FIG. 9B, cover 28 may comprise one or more clips 126 on an interior surface of cover 28. The clips 126 can engage a surface on the corresponding stretcher or support, such as a surface on support 128. The clips may slide over an edge of support 128 securing the cover 28 to lower stretcher 18 or upper stretcher 26. To remove, the cover 28 slides upward to disengage the clips 126 from the support 128 of lower stretcher 18 or upper stretcher 26.

Another embodiment of cover 28 may comprise one or more snaps on an interior surface. The snaps may engage a lower and/or upper surface of lower stretcher 18. A lower set of snaps may be engaged with a lower surface of lower stretcher 18 and pivoted upward to engage an upper set of snaps with an upper surface of lower stretcher 18. To remove, the cover pops off. In addition to clips or snaps, other connectors are contemplated by the current invention, including hooks, magnets, screws, etc.

Referring to FIGS. 10A-D, an external cable management system may be provided in addition to or instead of the cable management system within lower stretcher 18, upper stretcher 26, and posts 16*a* and 16*b*. Mounting plate 132 may include brackets 130 having hooks 138 (see FIG. 10C) for engagement with slots 38 and 44 (see FIG. 10A). Mounting plate 132 may be installed in a manner similar to installation of the lower stretcher 18 and upper stretcher 26. That is, the hooks 138 may be aligned with slots 38 and 44 and then mounting plate 132 may be forced downward to secure the hooks 138 in the slots 38 and 44 on a side of one of the posts 16*a*, 16*b*. A vertical trough 134 may snap onto mounting plate 132. Once installed, the interior space of trough 134 may receive and route cables or wires throughout the wall panel system.

Figure 10B:
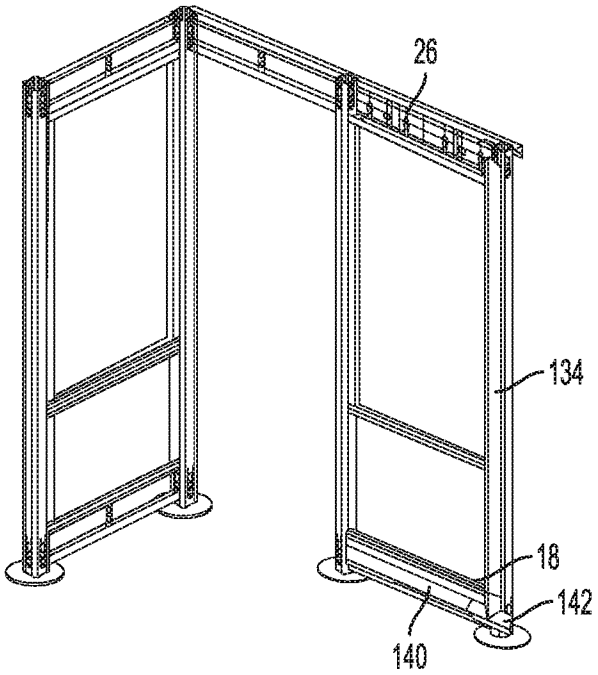
FIG. 10B is a perspective view of an external cable management system of a wall panel of FIG. 10A.
Figure 10A:
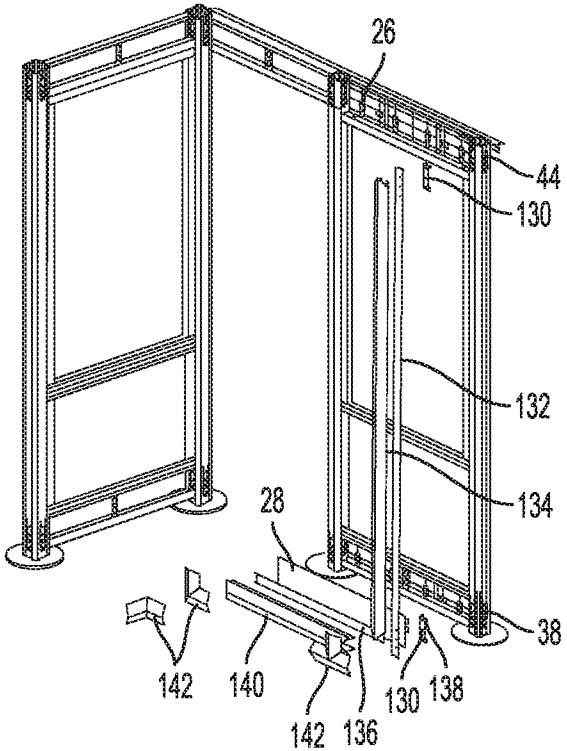
FIG. 10A is an exploded view of an external cable management system of a wall panel of FIG. 1A.
Figure 10C:
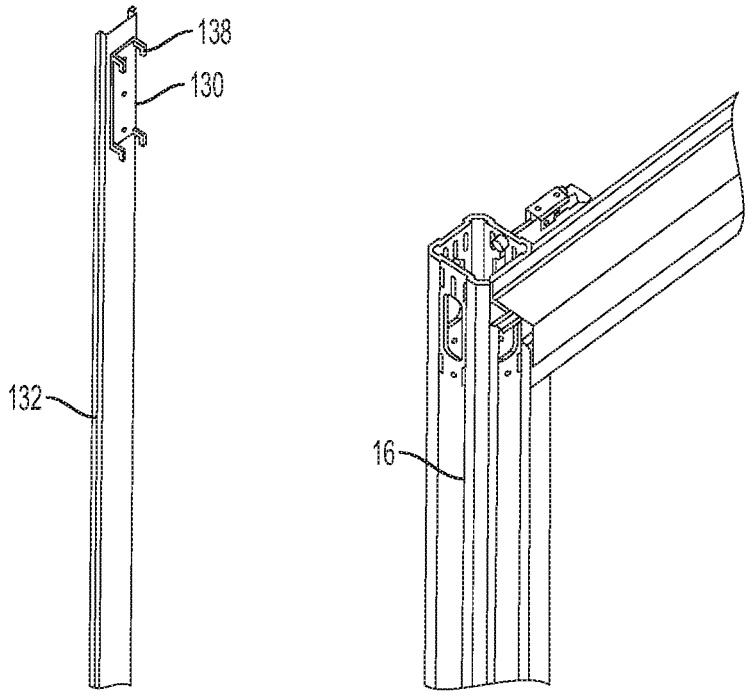
FIG. 10C is a detail view of a mounting plate of an external cable management system of a wall panel of FIG. 10A.
Figure 10D:
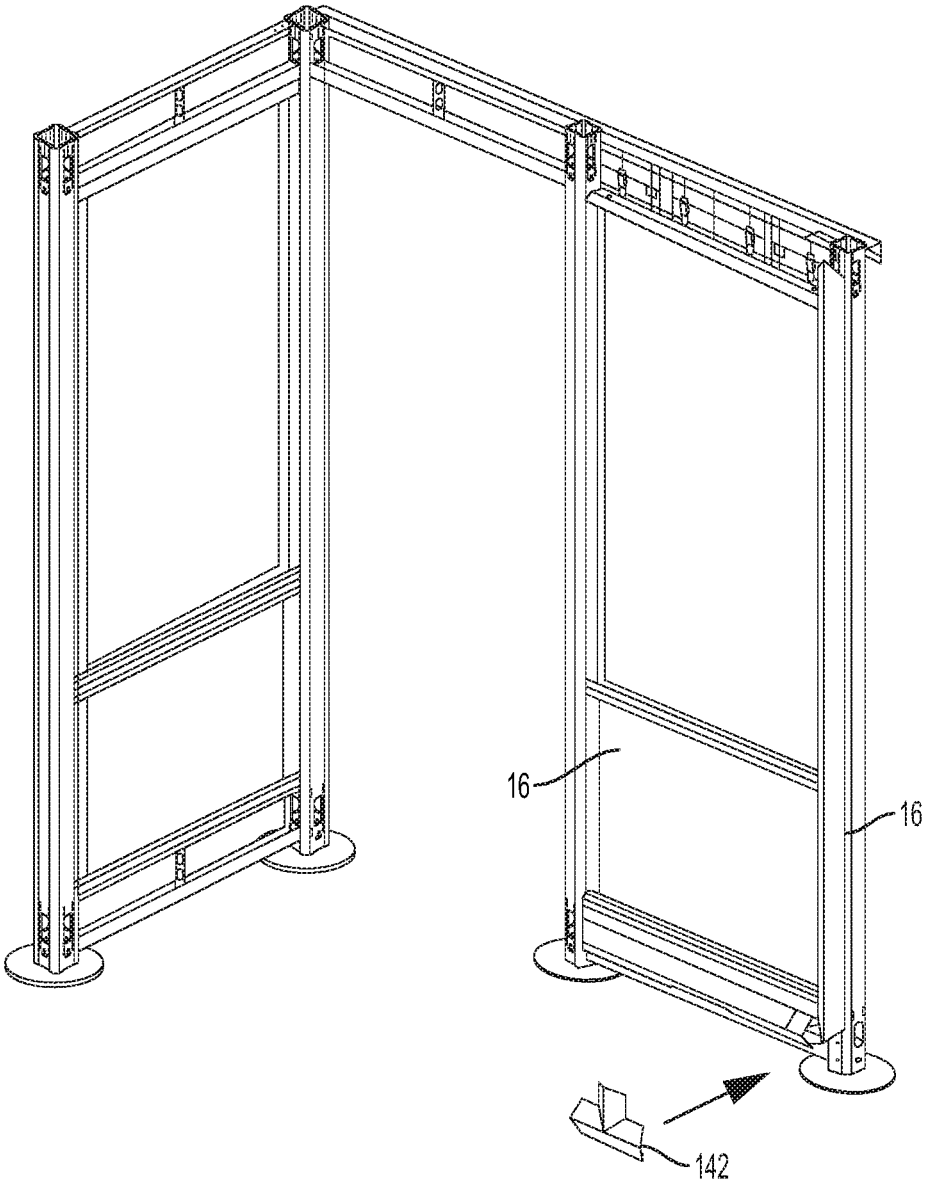
FIG. 10D is a detail view of a cable cover of an external cable management system of a wall panel of FIG. 10A.

With continued reference to FIG. 10A, lower stretcher 18 may include a cover 28 as previously described. A mounting plate 136 may be attached to the cover 28 and a horizontal trough 140 may snap onto mounting plate 136. Once installed, the interior space of trough 140 may receive and route cables or wires through the wall panel system. Cable covers 142 may be used to connect horizontal trough 140 and vertical trough 134 with additional troughs on the same or adjacent wall panels. Cable covers 142 may snap onto horizontal troughs 140 and vertical troughs 134 to conceal the transition between horizontal and vertical troughs (FIG. 10D). When multiple wall panels 10 are installed with multiple horizontal troughs 140 and vertical troughs 134, a network of cable paths is achieved. Electrical outlets, Ethernet ports, auxiliary ports, communication ports, and other known connections may now be placed in multiple locations along the height and width of the wall panel 10 to allow for connection of devices to cables routed through the cable management system.

Figure 11:
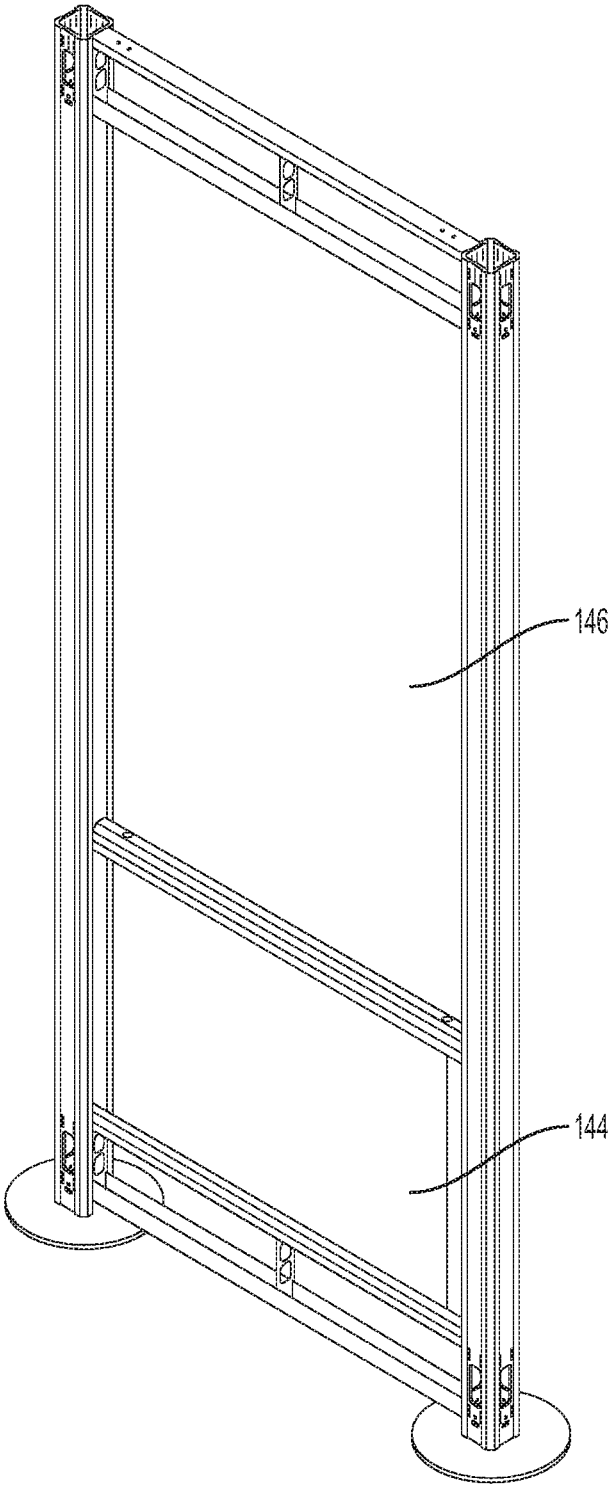
FIG. 11 is a perspective view of an alternative wall panel of FIG. 1A.
Figure 12B:
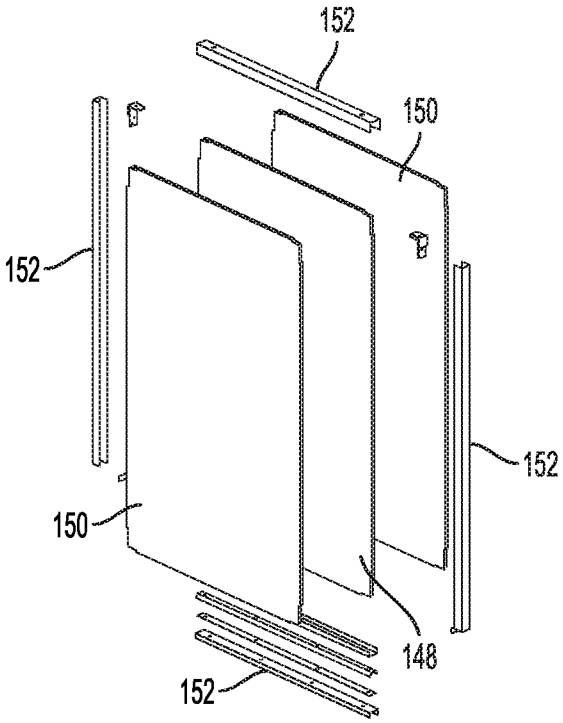
FIG. 12B is an exploded view of a panel for a wall panel of FIG. 12A.
Figure 12A:
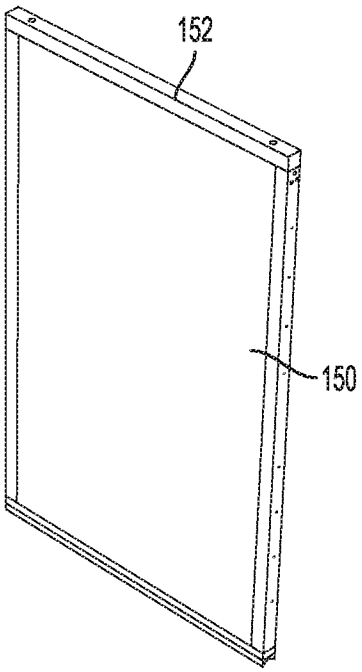
FIG. 12A is a perspective view of a panel for a wall panel of FIG. 1A.

Although the figures depict wall panel 10 comprising lower frame 20, middle frame 22, and upper frame 24, a person of skill in the art will recognize that the skeleton created by lower stretcher 18, upper stretcher 26, and posts 16*a*, 16*b* may support other embodiments. One such embodiment may be a single frame. Another embodiment may include two frames, as depicted in FIGS. 9-11. As shown in FIG. 11, the two frames may include a lower frame 144 and an upper frame 146. As mentioned previously, each of the frames may support a panel comprising any combination of the previously described latching members. The single frame or multiple frames may comprise a panel comprising any combination of plastic, clear glass, frosted glass, sound insulating foam, sound dampening material, fabric wrapped fiberglass, and medium density fiberboard (MDF), and other desired wall panel materials. The panels may comprise one or more of the above listed materials either integrally or separately formed with the frame. For example, as seen in FIGS. 12A and 12B, the panels may include a MDF mounting board 148 attached between two fabric wrapped fiberglass panels 150. The panels may be bounded by a frame 152 which may be constructed of aluminum, plastic, other metals, or any other structurally supportive material. The panels of the single frame or multiple frames may be continuous with each frame.

Figure 13B:
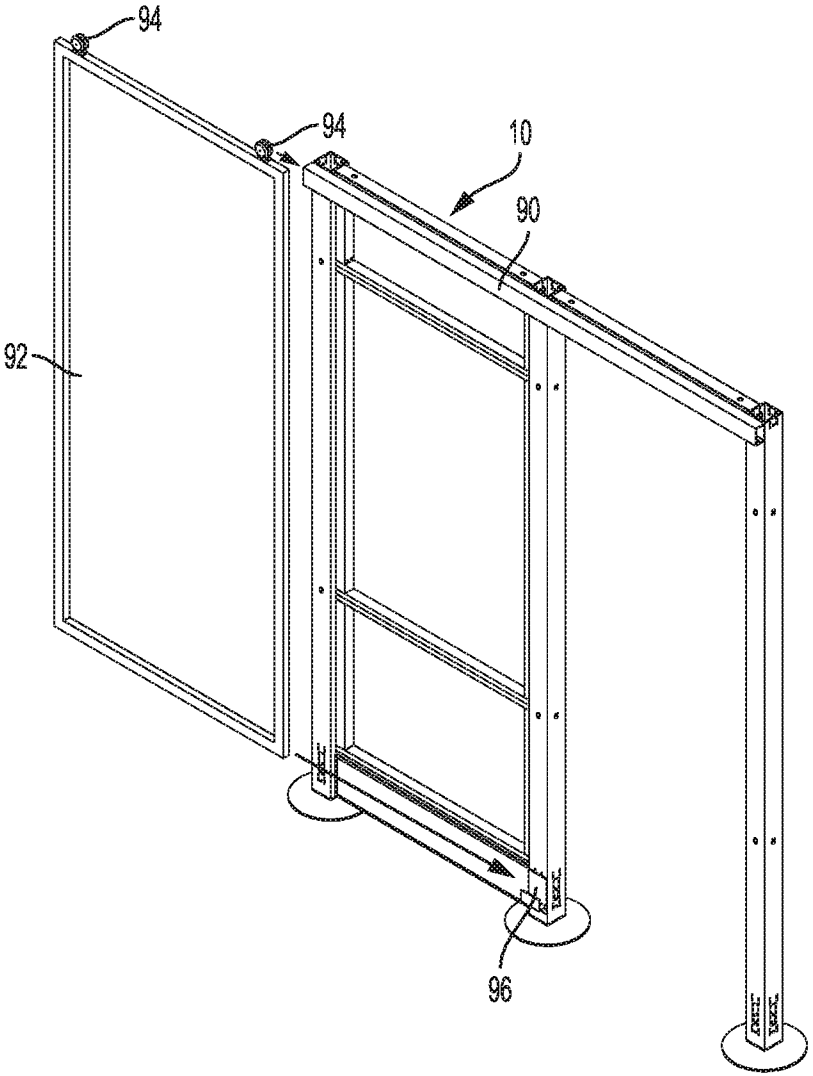
FIGS. 13A and 13B are perspective views of the wall panel of FIG. 1A including an embodiment of a sliding door assembly.
Figure 13A:
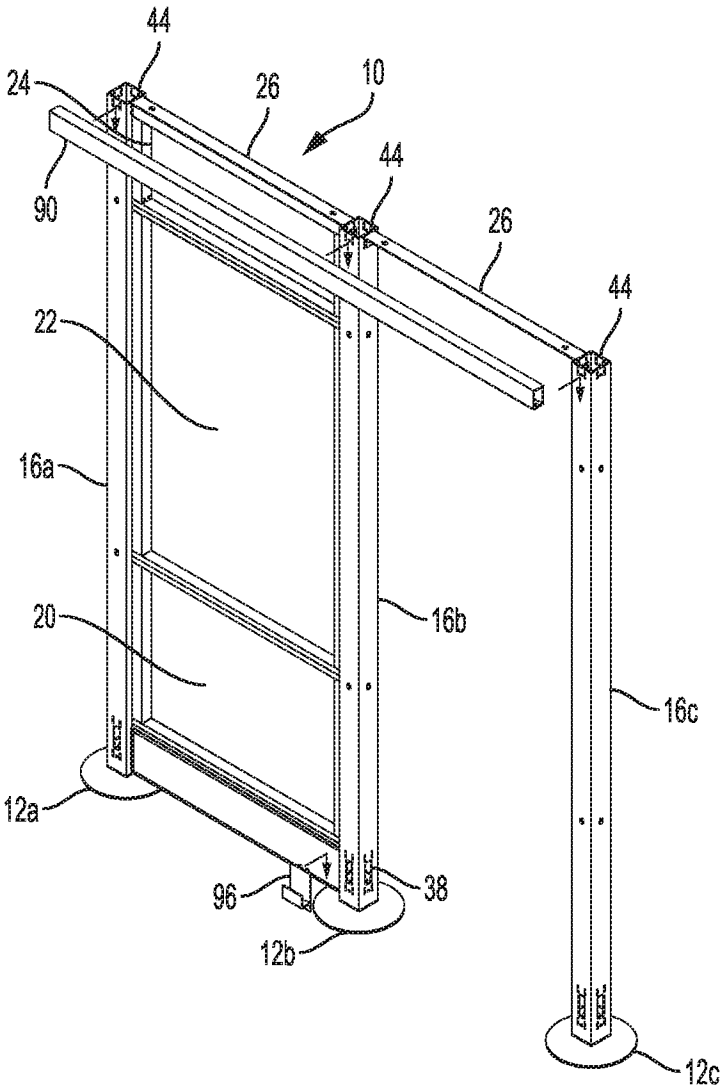
Figure 13C:
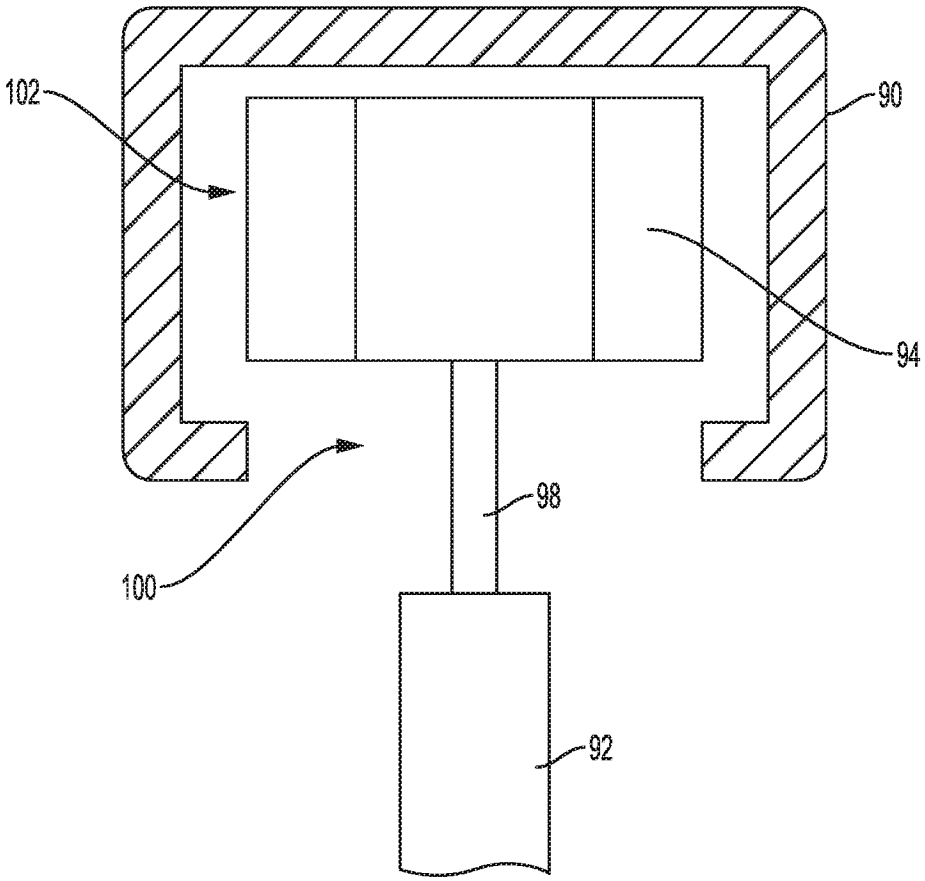
FIG. 13C is a partial cross-sectional view of the sliding door assembly of FIG. 13A.

Referring now to FIGS. 13A-13C, the wall panel system of the present invention may be seen including a door 92 moveable between an open position and a closed position. A third post 16*c*, third base plate 12*c*, and second upper stretcher 26 may connect to a wall panel 10 of FIG. 1A (or other embodiments of wall panel 10). As seen in FIG. 13A, a door hanger 90 may be connected to slots 44 of posts 16*a*, 16*b*, and 16*c* with corresponding hooks (not depicted). A door 92 fitted with one or more wheels 94, may be hung from door hanger 90 to provide access through a wall panel system. Door hanger 90 may comprise hooks (not depicted) which engage slots 44 to secure the door hanger 90 to the wall panel system. As can be seen in FIG. 13C, wheel(s) 94 may comprise an extension 98 connecting the wheel(s) 94 to the door 92. The extension 98 may extend through an opening 100 of door hanger 90 such that wheel(s) 94 are engaged within a track 102 of door hanger 90. The door may be guided by a door guide 96 located on one of the posts 16*a*, 16*b*, 16*c*. For example, door guide 96 may be attached to slots 38 of post 16*b* by corresponding hooks.

Figure 14B:
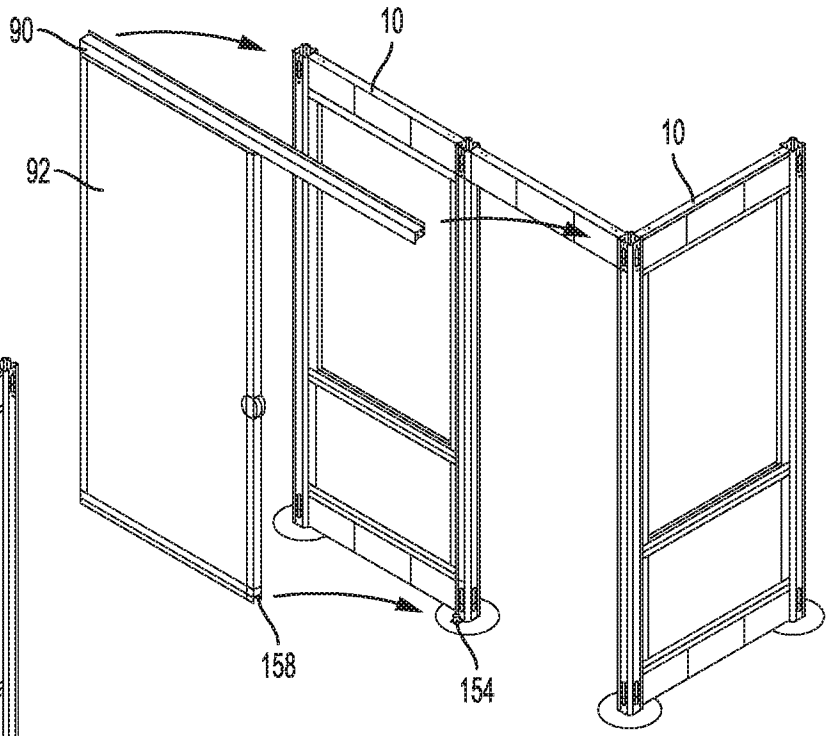
FIGS. 14A and 14B are perspective views of the wall panel of FIG. 1A including an alternative sliding door assembly.
Figure 14A:
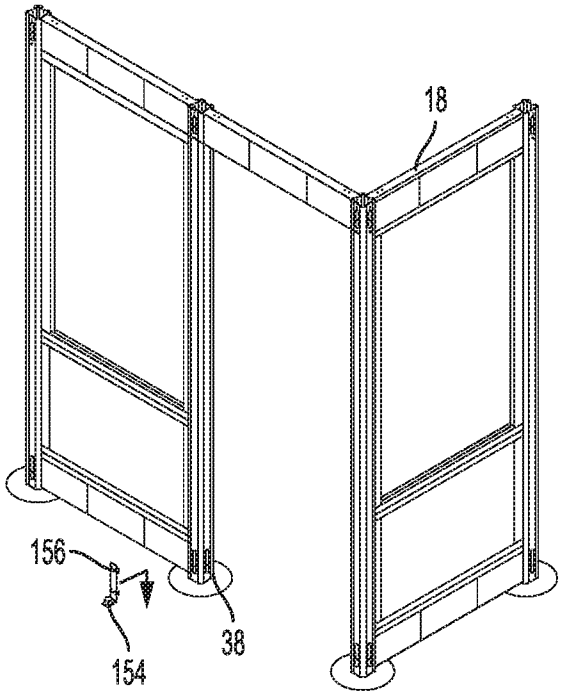

Referring to FIGS. 14A and 14B, an alternative embodiment of door 92 may be seen. Door 92 may be hung in the same manner as described in FIG. 13C. The door 92 may be moveable between an open position and a closed position. In place of door guide 96, a door guide 154 may be used. The door guide 154 may have hooks 156 (see FIG. 14A) for engaging slots 38. Once installed, the door guide 154 may guide door 92 via engagement with a track 158 located on a bottom surface of the door 92. The door guide 154 may be generally circular or egg-shaped to facilitate guiding of the door. The door 92 may be installed in track 102 of door hanger 90 and then door 92 may be lifted above the door guide 154 and lowered such that the hooks on door hanger 90 engage slots 44 simultaneously or substantially simultaneously with the track 158 on the door 92 engaging the door guide 154.

With assembly of a single wall panel 10 described, a person of skill in the art will readily understand from this disclosure that multiple wall panels 10 may be assembled together to provide a separation for a large open area. Each post 16 may comprise the same connection points on one or more surfaces such that a wall panel may extend from post 16 in any or all directions. Such a feature allows for customization of a workspace. Referring to FIG. 14B, a wall panel 10 can be seen installed substantially perpendicular to the door 92 and associated wall panel 10. It can be appreciated from FIG. 14B, that multiple wall panels 10 may be added in any direction to create multiple rooms, divided areas, hallways, etc.

For example, a first post 16*a* may be connected to a second post 16*b* with any number of frames as described previously. After a first wall panel 10*a* is constructed, a third post 16*c* may be connected to second post 16*b* in the same manner. The third post 16*c* may be arranged such that when assembled with a frame or frames, a second wall panel 10*b* may be generally perpendicular to the wall panel 10*a*. A third wall panel 10*c* may be constructed by connecting a fourth post 16*d* to the third post 16*c* in the above described manner. A fourth wall panel 10*d* may be constructed by connecting post 16*d* to post 16*a* in the above described manner. A person of skill in the art will thus appreciate that an enclosed space is defined by wall panels 10*a*, 10*b*, 10*c*, and 10*d*. Many configurations of this enclosed space may be created with the described wall panel system.

Although the above example describes only one wall panel 10 extending in each direction, multiple wall panels 10 may be connected together in series to extend the walls of the enclosed space in each direction. Posts 16 may comprise more or less than four surfaces and each surface may comprise slots for corresponding frames and stretchers allowing the wall panels 10 to extend in any number of directions, thus allowing customization of each enclosed space constructed with the wall panels 10. Additionally, the walls may partially enclose a space such that one or more "walls" are actually open spaces through which entrance may be gained to the space enclosed by the wall panel 10. Similarly, it will be appreciated that one or more of the wall panels 10*a*-10*d* described above may be constructed as a door way.

Many configurations of an enclosed space may be created with the described wall panel system. The wall panels 10 may be constructed such that multiple rooms or enclosures are created. Each room or enclosure may have an opening to gain entry. The opening may comprise a door as described above or any door suitable to gain entry, such as a hinged door. The multiple rooms or enclosures may be of the same or similar size or may be of varying sizes. The size of the room or enclosure may be dependent on the number of wall panels 10 used to construct the room or enclosure. The wall panels 10 may also be constructed so as to form hallways or may use an existing structure or wall to form one wall of an enclosure. Thus, individual customized spaces may be created based on the desired function and use of the space.

Figure 15A:
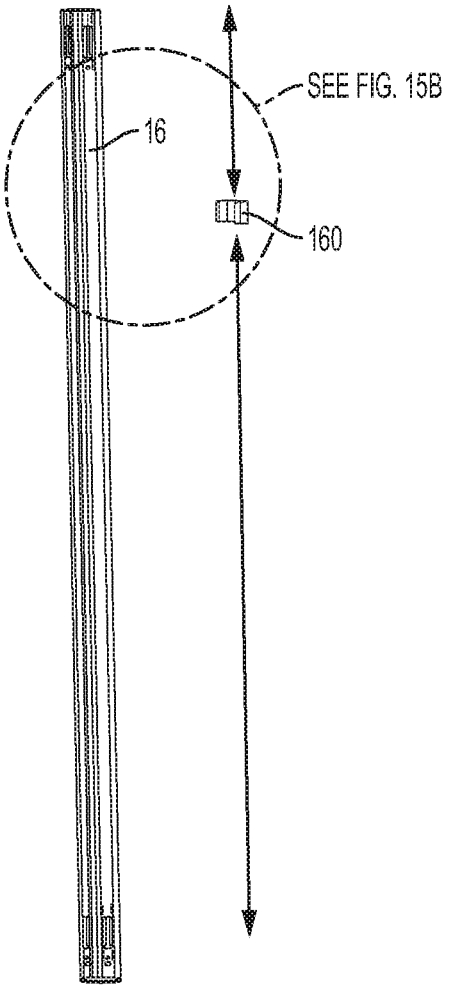
FIG. 15A is a perspective view of a wall mounting bracket for a wall panel of FIG. 1A.
Figure 15B:
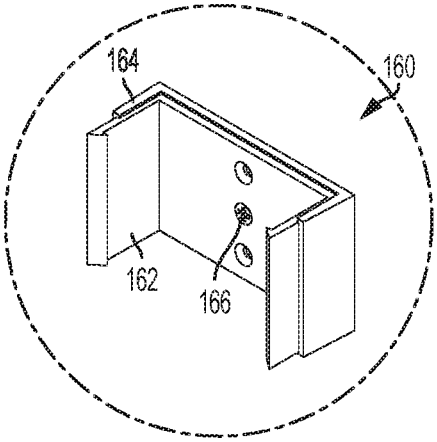
FIGS. 15B and 15C are detailed views of a wall mounting bracket for a wall panel of FIG. 15A.
Figure 15C:
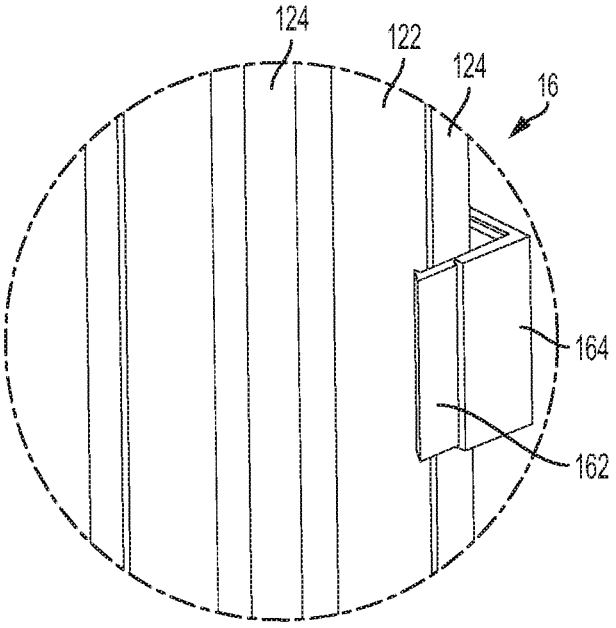

Referring to FIGS. 15A-15C, where the wall panel system of the present invention is adjacent a building wall, a wall mounting bracket 160 may be provided. As seen in FIG. 15B, the wall mounting bracket 160 comprises generally u-shaped or c-shaped brackets 162 and 164. Inner bracket 162 may be constructed of plastic or other flexible material such that it may receive a post 16 (FIG. 15C). The inner mounting bracket 162 may have generally angled protrusions to engage the reduced portion 122 between raised portions 124 of post 16. This can allow the inner mounting bracket 162 to snap on to the post. The inner mounting bracket 162 may be fastened, such as with a screw 166 to an outer bracket 164. Outer bracket 164 may be constructed of metal to provide strength and stability to the wall mounting bracket. The wall mounting bracket 160 may be installed at any height along the length of the post 16. It can be appreciated that with the inner flexible, plastic mounting bracket 162, the post may be pushed into the bracket and with the outer stronger metal mounting bracket 164, the wall panel system may limit movement from side to side or front to back.

Figure 16B:
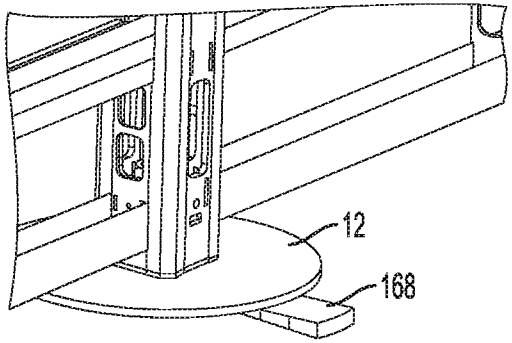
FIGS. 16A-16D are perspective views depicting an illustrative sequence of installation of a shim for a wall panel of FIG. 1A.
Figure 16D:
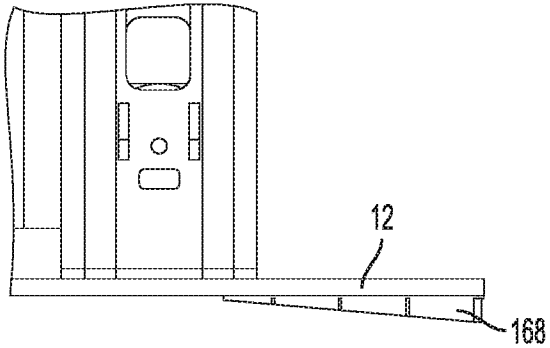
Figure 16A:
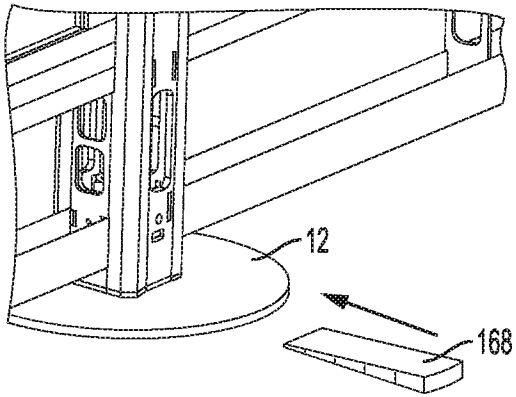
Figure 16C:
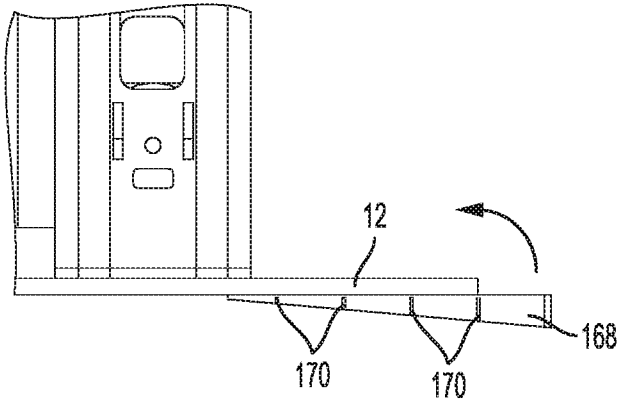

Referring to FIGS. 16A-16D, an additional leveling mechanism is shown. A shim 168 may be pushed under the base plate 12. The shim 168 may be forced under base plate 12 until the desired leveling is achieved (FIG. 16B). The shim 168 may have several profiled fracture lines 170. The shim 168 may then be folded up (FIG. 16C) or otherwise separated at fracture lines 170 to achieve a clean look (FIG. 16D). The shim may be of a plastic or rubber construction.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

The invention claimed is:

1. A wall panel, comprising:

a first upright post;

a second upright post;

a lower stretcher for connecting the first upright post to the second upright post;

an upper stretcher for connecting the first upright post to the second upright post;

at least one frame for placement within the first upright post, the second upright post, the lower stretcher, and the upper stretcher; and a first retractable latch located on the at least one frame, the first retractable latch adapted to engage at least one of the first upright post, second upright post, lower stretcher, or upper stretcher, wherein the first retractable latch comprises a spring-loaded latch.

2. The wall panel of claim 1, wherein the at least one frame comprises a trench on a lower surface; a rail on an upper surface; a first side surface; and a second side surface opposing the first side surface.

3. The wall panel of claim 2, wherein the first retractable latch is located on the rail and comprises an angled surface configured to be resiliently depressed upon engagement with the upper stretcher.

4. The wall panel of claim 2, wherein the first retractable latch is located on the first side surface and is configured to be retracted by a first slide located on the rail; and wherein the first retractable latch is configured to engage a first slot in the first upright post.

5. The wall panel of claim 1, further comprising a draw latch configured to couple the upper stretcher to at least one of the first upright post or the second upright post.

6. The wall panel of claim 5, wherein the draw latch comprises:

a rod having a foot for engaging the at least one of the first upright post and the second upright post; and a flange for locking the rod and foot into engagement with the at least one of the first upright post and the second upright post.

7. The wall panel of claim 1, wherein the at least one frame comprises a lower frame, a middle frame, and an upper frame.

8. The wall panel of claim 7, wherein the lower frame comprises a trench on a lower surface, a rail on an upper surface, and a first slide located on a top surface of the rail, wherein the first retractable latch is located on a side surface of the rail, and wherein the first slide is configured to retract the first retractable latch.

9. The wall panel of claim 8, wherein the first retractable latch is located on a side surface of the lower frame.

10. The wall panel of claim 7, wherein the middle frame comprises a trench on a lower surface, a rail on an upper surface, and a first slide configured to retract the first retractable latch located on the rail.

11. The wall panel of claim 10, wherein the first retractable latch is located on a side surface of the middle frame.

12. The wall panel of claim 7, wherein the upper frame comprises a trench on a lower surface, a rail on an upper surface; and wherein the first retractable latch is located on the rail and comprises an angled surface configured to be depressed upon engagement with the upper stretcher.

13. The wall panel of claim 1, further comprising at least one first hook slot in the first upright post and at least one second hook slot in the second upright post;

wherein the at least one first hook slot and the at least one second hook slot are configured to receive at least one first hook and at least one second hook located on opposing side surfaces of the lower stretcher or the upper stretcher.

14. The wall panel of claim 1, wherein at least one of the lower stretcher and the upper stretcher further comprise a first plurality of openings on a first side surface and a second plurality of openings on a second side surface;

wherein the first plurality of openings is configured to align with at least one opening on the first upright post;

wherein the second plurality of openings is configured to align with at least one opening on the second upright post; and wherein the at least one opening on the first upright post, the first plurality of openings, the second plurality of openings, and the at least one opening on the second upright post are configured to receive and route cables through the wall panel.

15. The wall panel of claim 1, further comprising at least one cover placed on an outer surface of the lower stretcher.

16. The wall panel of claim 15, wherein the cover comprises at least one clip configured to engage an outer surface of the lower stretcher.

17. The wall panel of claim 15, wherein the cover comprises at least one snap configured to engage an outer surface of the lower stretcher.

18. The wall panel of claim 1, further comprising a second retractable latch located on the at least one frame, the second retractable latch adapted to engage the other of the first and second upright posts.

19. The wall panel of claim 18, wherein the first retractable latch and the second retractable latch are simultaneously retracted to align with the first upright post and the second upright post, and wherein the first retractable latch and the second retractable latch are simultaneously released to engage the first upright post and the second upright post.

20. The wall panel of claim 1, wherein the at least one frame houses a panel of at least one of plastic, clear glass, frosted glass, sound insulating foam, sound dampening material, fabric wrapped fiberglass, or medium density fiberboard.

21. The wall panel of claim 1, wherein at least one of the lower stretcher or the at least one frame comprises a rail;

wherein the rail comprises a first angled surface and a second angled surface connected by a substantially horizontal surface; and wherein the rail is configured to mate with a trench on an adjacent part.

22. The wall panel of claim 1, wherein the at least one frame comprises a trench;

wherein the trench comprises a first angled surface and a second angled surface connected by a substantially horizontal surface; and wherein the trench is configured to mate with a rail on an adjacent part.

23. The wall panel of claim 1, wherein the lower stretcher comprises a rail on an upper surface thereof configured to mate with a trench on the at least one frame to provide engagement between the lower stretcher and the at least one frame.

24. The wall panel of claim 23, wherein the trench is generally concave and the rail is generally convex.

25. The wall panel of claim 23, wherein the trench comprises a first angled surface and a second angled surface connected by a first substantially horizontal surface;

wherein the rail comprises a third angled surface and a fourth angled surface connected by a second substantially horizontal surface; and wherein the first angled surface is configured to mate with the third angled surface, the second angled surface is configured to mate with the fourth angled surface, and the first substantially horizontal surface is configured to mate with the second substantially horizontal surface, to provide engagement between the lower stretcher and the at least one frame.

26. A frame for a wall panel, comprising:

an upper surface, a lower surface, a first side surface, and a second side surface opposing the first side surface;

a rail located on the upper surface;

a trench located on the lower surface; and a first retractable latch and a second retractable latch, wherein the first retractable latch and the second retractable latch are each located on the rail and each comprises an angled surface configured to be depressed upon engagement with an upper stretcher.

27. The frame of claim 26, wherein at least one of the rail or the trench comprise a first angled surface and a second angled surface connected by a substantially horizontal surface.

28. The frame of claim 26, wherein a cross-section of the trench is such that the trench is configured to engage a rail of an adjacent frame.

29. The frame of claim 26, wherein the upper surface, the lower surface, the first side surface, and the second side surface house a panel of at least one of plastic, clear glass, frosted glass, sound insulating foam, sound dampening material, fabric wrapped fiberglass, or medium density fiberboard (MDF).

30. The frame of claim 26, wherein the first retractable latch comprises a spring-loaded latch and the second retractable latch comprises a spring-loaded latch.

31. A frame for a wall panel, comprising:

an upper surface, a lower surface, a first side surface, and a second side surface opposing the first side surface;

a rail located on the upper surface;

a trench located on the lower surface; and a first retractable latch and a second retractable latch, wherein the first retractable latch and the second retractable latch are located on the first and second side surfaces, respectively; and wherein the first retractable latch is configured to be retracted by a first slide and the second retractable latch is configured to be retracted by a second slide; and wherein the first slide and the second slide are located on the rail.

32. A method of assembling a wall panel system, comprising:

providing a first upright post;

providing a second upright post;

connecting a lower stretcher to the first upright post and to the second upright post;

connecting an upper stretcher to the first upright post and to the second upright post;

connecting at least one frame within the first upright post, the second upright post, the lower stretcher, and the upper stretcher using a first retractable latch, wherein the step of connecting the at least one frame comprises placing a trench on a lower surface of the at least one frame onto one of a rail of an upper surface of the lower stretcher or a rail of an upper surface of an adjacent frame; and pivoting the at least one frame to a substantially upright position thus engaging the first retractable latch with a first slot on the first upright post.

33. The method of claim 32, wherein the step of connecting the lower stretcher comprises connecting a plurality of hooks on a first side of the lower stretcher with a plurality of slots located on the first upright post; and connecting a second plurality of hooks on a second side of the lower stretcher with a second plurality of slots located on the second upright post.

34. The method of claim 32, wherein the step of connecting the upper stretcher comprises connecting a plurality of hooks on a first side of the upper stretcher with a plurality of slots located on the first upright post; and connecting a second plurality of hooks on a second side of the upper stretcher with a second plurality of slots located on the second upright post.

35. The method of claim 32, wherein the step of engaging comprises moving a first slide associated with the first retractable latch inwardly to retract the first retractable latch; and after pivoting the at least one frame into the substantially upright position, releasing the first slide to extend the first retractable latch into engagement with the first slot.

36. The method of claim 32, further comprising a second retractable latch located on the at least one frame, wherein the at least one frame is connected within the first upright post, the second upright post, the lower stretcher, and the upper stretcher using the second retractable latch.

37. The method of claim 36, wherein the first retractable latch and the second retractable latch are simultaneously retracted to align with the first upright post and the second upright post, and wherein the first retractable latch and the second retractable latch are simultaneously released to engage the first upright post and the second upright post.

38. A method of assembling a wall panel system, comprising:

providing a first upright post;

providing a second upright post;

connecting a lower stretcher to the first upright post and to the second upright post;

connecting an upper stretcher to the first upright post and to the second upright post;

connecting at least one frame within the first upright post, the second upright post, the lower stretcher, and the upper stretcher using a first retractable latch, wherein the step of connecting the at least one frame comprises placing a trench on a lower surface of the at least one frame onto a rail of an adjacent frame; and pivoting the at least one frame to a substantially upright position thus engaging the first retractable latch with a first slot on the upper stretcher.

39. The method of claim 38, wherein the step of engaging comprises moving an angled surface of the first retractable latch into engagement with the upper stretcher, thus depressing the first retractable latch; and after pivoting the at least one frame into the substantially upright position, releasing the first retractable latch into engagement with a first slot located on the upper stretcher.

40. A wall panel, comprising:

a first upright post;

a second upright post;

a lower stretcher for connecting the first upright post to the second upright post;

an upper stretcher for connecting the first upright post to the second upright post;

at least one frame for placement within the first upright post, the second upright post, the lower stretcher, and the upper stretcher; and a first retractable latch located on the at least one frame, the first retractable latch adapted to engage at least one of the first upright post, second upright post, lower stretcher, or upper stretcher, wherein the at least one frame comprises a lower frame, a middle frame, and an upper frame, wherein the lower frame comprises a trench on a lower surface, a rail on an upper surface, and a first slide located on a top surface of the rail, wherein the first retractable latch is located on a side surface of the rail, and wherein the first slide is configured to retract the first retractable latch.

41. A wall panel, comprising:

a first upright post;

a second upright post;

a lower stretcher for connecting the first upright post to the second upright post;

an upper stretcher for connecting the first upright post to the second upright post;

at least one frame for placement within the first upright post, the second upright post, the lower stretcher, and the upper stretcher; and a first retractable latch located on the at least one frame, the first retractable latch adapted to engage at least one of the first upright post, second upright post, lower stretcher, or upper stretcher, wherein the at least one frame comprises a trench;

wherein the trench comprises a first angled surface and a second angled surface connected by a substantially horizontal surface; and wherein the trench is configured to mate with a rail on an adjacent part.

42. A wall panel, comprising:

a first upright post;

a second upright post;

a lower stretcher for connecting the first upright post to the second upright post;

an upper stretcher for connecting the first upright post to the second upright post;

at least one frame for placement within the first upright post, the second upright post, the lower stretcher, and the upper stretcher; and a first retractable latch located on the at least one frame, the first retractable latch adapted to engage at least one of the first upright post, second upright post, lower stretcher, or upper stretcher, wherein the lower stretcher comprises a rail on an upper surface thereof configured to mate with a trench on the at least one frame to provide engagement between the lower stretcher and the at least one frame.

43. A frame for a wall panel, comprising:

an upper surface, a lower surface, a first side surface, and a second side surface opposing the first side surface;

a rail located on the upper surface;

a trench located on the lower surface; and a first retractable latch and a second retractable latch, wherein the first retractable latch comprises a spring-loaded latch and the second retractable latch comprises a spring-loaded latch.

* * * * *